US007561825B2

(12) United States Patent
Hirose et al.

(10) Patent No.: US 7,561,825 B2
(45) Date of Patent: Jul. 14, 2009

(54) IMAGE FORMING APPARATUS THAT RESTRICTS EXCESSIVE PIVOTAL MOVEMENT OF IMAGE READING UNIT

(75) Inventors: Atsuo Hirose, Nagoya (JP); Yoshiteru Hattori, Ichinomiya (JP); Sakae Ito, Nishikasugai (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 350 days.

(21) Appl. No.: 11/255,105

(22) Filed: Oct. 21, 2005

(65) Prior Publication Data

US 2006/0088336 A1 Apr. 27, 2006

(30) Foreign Application Priority Data

Oct. 22, 2004 (JP) ..... 2004-308746

(51) Int. Cl.
*G03G 21/16* (2006.01)

(52) U.S. Cl. ..... 399/110

(58) Field of Classification Search ..... 399/110
See application file for complete search history.

(56) References Cited

U.S. PATENT DOCUMENTS

| | | | | |
|---|---|---|---|---|
| 5,162,846 | A * | 11/1992 | Cahill | 399/125 |
| 6,510,301 | B2 * | 1/2003 | Tanaka | 399/125 |
| 6,741,820 | B2 * | 5/2004 | Nobe et al. | 399/110 |
| 2002/0061206 | A1 * | 5/2002 | Enomoto et al. | 399/124 |
| 2005/0031371 | A1 * | 2/2005 | Kaida et al. | 399/110 |
| 2005/0135855 | A1 * | 6/2005 | Park et al. | 399/405 |

FOREIGN PATENT DOCUMENTS

| | | | |
|---|---|---|---|
| JP | 10-16353 | A | 1/1998 |
| JP | 2001-34141 | A | 2/2001 |
| JP | 2001-281771 | A | 10/2001 |
| JP | 2003241460 | | 8/2003 |
| JP | 2004-258149 | A | 9/2004 |

OTHER PUBLICATIONS

CN Office Action dtd Jun. 1, 2007, CN App. 200510114343.1.
JP Office Action Aug. 19, 2008, JP App. 2004-308746.

* cited by examiner

*Primary Examiner*—David M Gray
*Assistant Examiner*—Andrew V Do
(74) *Attorney, Agent, or Firm*—Banner & Witcoff, Ltd.

(57) ABSTRACT

A discharge tray is provided on a predetermined surface of an image forming unit for receiving a recording medium discharged from the image forming unit. The image reading unit is disposed in confrontation with the discharge tray for reading an image from an original document. The coupling portion is disposed at a first position on the image forming unit. The coupling portion couples the image reading unit with the image forming unit, allowing the image reading unit to pivotally move about a first pivoting axis. The image reading unit is pivotally movable between a closed position for covering the discharge tray and an open position for exposing the discharge tray. The pivoting-restricting portion is disposed at a second position different from the first position. The pivoting-restricting portion restricts pivotal movement of the image reading unit past the open position in an opening direction.

18 Claims, 17 Drawing Sheets

IMAGE FORMING APPARATUS THAT RESTRICTS EXCESSIVE PIVOTAL MOVEMENT OF IMAGE READING UNIT

BACKGROUND OF THE INVENTION

1. Field of the Invention

The present invention relates to an image forming apparatus, and more particularly to an image forming apparatus having a mid-body paper discharge system where a discharge tray is provided between an image forming unit and an image reading unit.

2. Description of Related Art

Conventional image forming apparatuses are provided with a discharge tray on outside of a main body (left or right side of the main body) for discharging a recording medium (a sheet of paper, for example) that has undergone a desired image forming process. However, this type of discharge system requires additional installation space for the discharge tray in addition to the installation space for the main body.

Therefore, as disclosed in Japanese patent-application publication No. 2003-241460, an image forming apparatus having a mid-body paper discharge system has been proposed in recent years. The image forming apparatus includes a main body having an image forming unit, an image reading unit disposed at a position above the main body, and a discharge tray positioned between the image forming unit and the image reading unit. The image reading unit is supported on the main body in such a manner that image reading unit is pivotally movable about a pivoting axis. By pivotally moving the image reading unit open to widen the space between the two units, an operator can easily retrieve paper from the discharge tray.

SUMMARY

However, with the above-described construction, the operator must pivotally move the image reading unit to retrieve paper from the discharge tray each time. In order to eliminate the inconvenience of this operation, supports can be provided for maintaining the image reading unit at an inclined state to the main body.. However, the following problems occur when simply providing such support.

First, the image reading unit may interfere with peripheral equipment or the like if the operator pivotally moves the image reading unit too far for retrieving paper. In addition, when moving the entire apparatus, the operator may grab the left and right edges of the image reading unit. In this case, the main body will hang from the image reading unit, causing interference between parts of the main body and parts of the image reading unit around the pivoting axis and could cause damage to parts around the pivoting axis.

In view of the foregoing, it is an object of the present invention to provide an image forming apparatus capable of facilitating smooth retrieval of a recording medium from a discharge tray and capable of restricting excessive pivotal movement of the image reading unit.

In order to attain the above and other objects, the present invention provides an image forming apparatus. The image forming apparatus includes an image forming unit, a discharge tray, an image reading unit, a coupling portion, and a pivoting-restricting portion. The image forming unit forms an image on a recording medium. The image forming unit has a predetermined surface. The discharge tray is provided on the predetermined surface for receiving the recording medium discharged from the image forming unit. The image reading unit is disposed in confrontation with the discharge tray for reading an image from an original document. The coupling portion is disposed at a first position on the image forming unit. The coupling portion couples the image reading unit with the image forming unit, allowing the image reading unit to pivotally move about a first pivoting axis. The image reading unit is pivotally movable between a closed position at which the image reading unit covers the discharge tray and an open position at which the image reading unit exposes the discharge tray. The image reading unit is pivotally movable both in an opening direction toward the open position and in a closing direction toward the closed position. The pivoting-restricting portion is disposed at a second position different from the first position. The pivoting-restricting portion restricts pivotal movement of the image reading unit past the open position in the opening direction.

BRIEF DESCRIPTION OF THE DRAWINGS

The above and other objects, features and advantages of the invention will become more apparent from reading the following description of the embodiments taken in connection with the accompanying drawings in which.

DETAILED DESCRIPTION OF THE EMBODIMENTS

An image forming apparatus according to an embodiment of the present invention will be described while referring to FIGS. 1 through 17. In the following description, the expressions "front", "rear", "right", and "left" are used to define the various parts of the image forming apparatus when the image forming apparatus is disposed in an orientation in which it is intended to be used.

Figure 1:
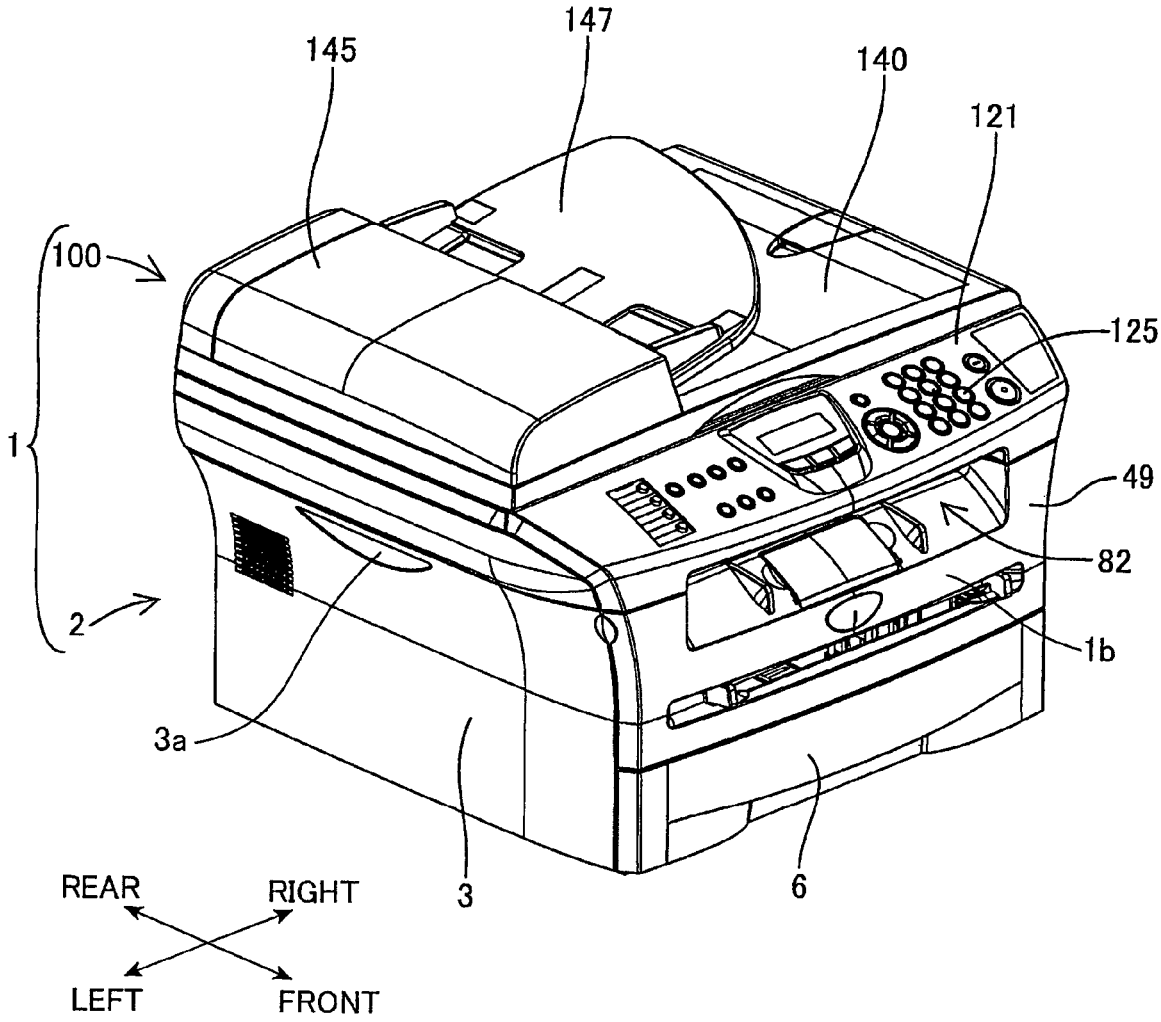
FIG. 1 is a perspective view showing a multifunction device according to an embodiment of the present invention.

FIG. 1 is a perspective view showing a multifunction device 1 according to the embodiment. The multifunction device 1 includes an image forming unit 2 having a main casing 3, and an image reading unit 100 disposed on the top of the image forming unit 2, whereby the multifunction device 1 has facsimile, scanner, and printer functions. As will be described in detail later, the multifunction device 1 employs a mid-body paper discharge system, with a discharge tray 46 (FIG. 2) positioned between the image forming unit 2 and the image reading unit 100. Note that, in the present embodiment, "front", "rear", "right", and "left" of the multifunction device 1 are defined as indicated in the drawings.

First the image forming unit 2 will be described, followed by a description of the image reading unit 100.

Image Forming Unit

Figure 5:
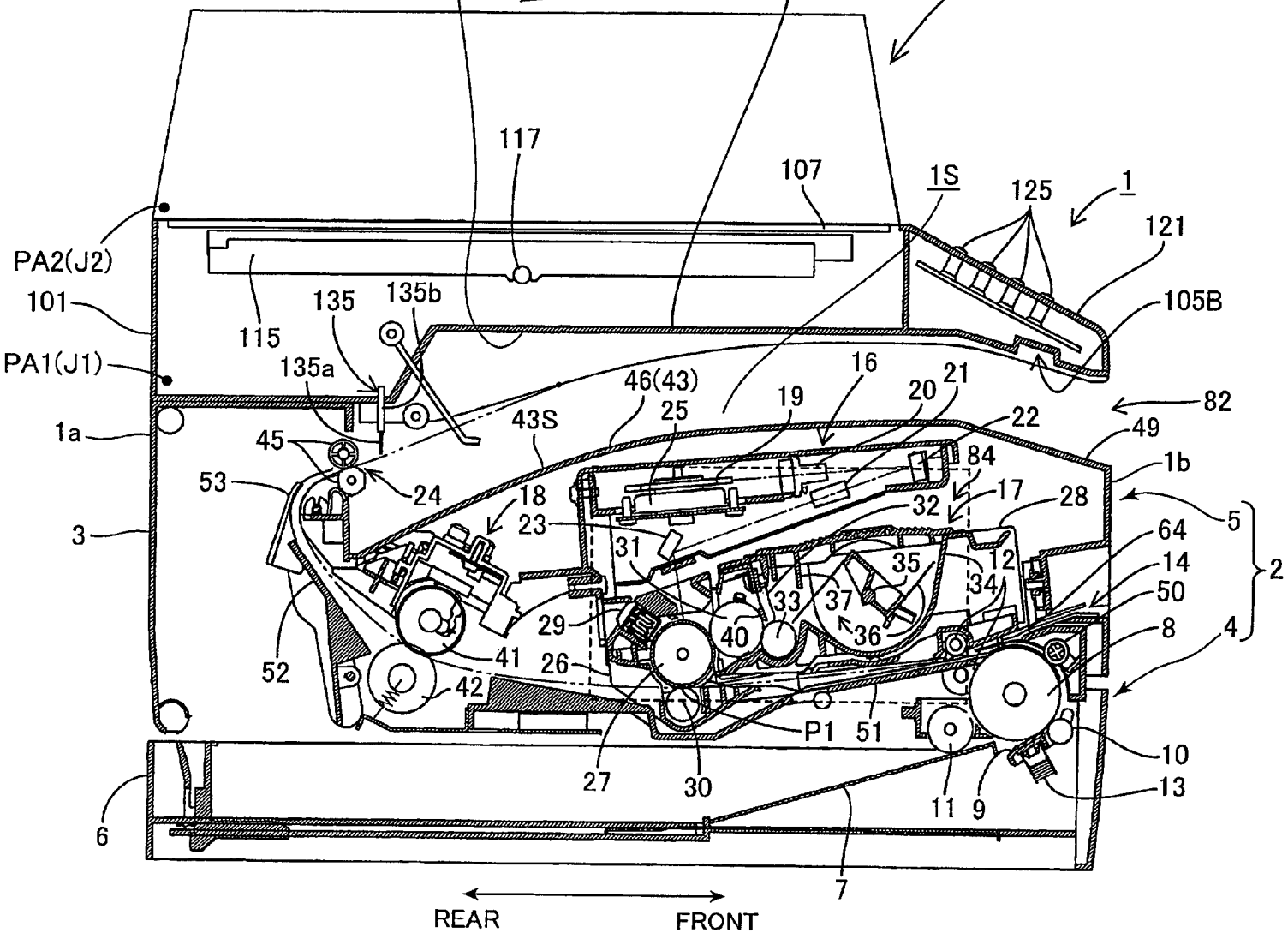
FIG. 5 is a vertical cross-sectional view of the multifunction device.

FIG. 5 is a vertical cross-sectional view of the multifunction device 1. As shown in FIG. 5, the image forming unit 2 includes a feeder unit 4 disposed in a bottom section of the main casing 3 for feeding sheets of paper; and an image forming unit 2 disposed above the feeder unit 4 for forming images on the paper supplied from the feeder unit 4. In the following description, the left-to-right direction will refer to a direction orthogonal to the surface of the drawing in FIG. 5.

As shown in FIGS. 1 through 4, 6, and 7, handles 3*a* for holding the multifunction device 1 are provided on the left and right sides of the main casing 3. Note that only one of the right-side and left-side handles 3*a* is shown in FIGS. 1 through 4, and 7. Also note that the location of the handles 3*a* is indicated by a dotted line in FIG. 6. The handles 3*a* are located slightly to the rear from the center of the multifunction device 1 in the front-to-rear direction. The handles 3*a* are also located slightly upward from the center of the multifunction device 1 in the vertical direction.

The feeder unit 4 includes a paper cassette 6 in the form of a thin tray, and, disposed above the front end of the paper cassette 6, a pickup roller 11, a feeding roller 8, a pinch roller 10, and registration rollers 12. Sheets of paper picked up and fed from the paper cassette 6 in a forward direction one sheet at a time are conveyed along a paper-conveying path (indicated by a two-dot chain line), which reverses the conveying direction of the sheets toward the rear side of the main casing 3. A major section of the paper-conveying path runs from the top of the feeding roller 8 to an image forming position P1 and is formed by a paper guide member 51 provided on the body of the multifunction device 1, and a bottom surface of a process unit 17.

The feeding roller 8 has a larger diameter than a photosensitive drum 27, a fixing roller 41, and the like described later (in the present embodiment, the diameter of the feeding roller 8 is 33 mm compared to diameters of 24 mm and 25 mm for the photosensitive drum 27 and fixing roller 41 respectively). By providing the feeding roller 8 with a relatively large diameter, it is possible to reduce the curvature produced in the sheets of paper, enabling the feeding roller 8 to convey thick paper such as postcards or the like without bending the paper.

As shown in FIG. 5, the paper cassette 6 includes a paper-pressing plate 7. The rear end of the paper-pressing plate 7 is pivotally supported in the paper cassette 6 so that the front end of the paper-pressing plate 7 nearest the feeding roller 8 can move vertically. A spring (not shown) is disposed on the underside of the paper-pressing plate 7 for urging the front end of the paper-pressing plate 7 upward so that the top surface on the front end of paper stacked in the paper cassette 6 is always in contact with the pickup roller 11.

A separating pad 9 is disposed near the bottom of the feeding roller 8. A spring 13 presses the separating pad 9 toward the feeding roller 8 to prevent a plurality of sheets from being supplied onto the conveying path in an overlapped state. Hence, paper that is picked up by the pickup roller 11 comes into contact with the feeding roller 8 and separating pad 9. At this time, the separating pad 9 applies a suitable frictional force to the paper so as to restrict all but the topmost sheet of paper when the pickup roller 11 picks up a plurality of sheets. As a result, the feeding roller 8 can feed the paper one sheet at a time. A paper dust roller 50 is also disposed in confronting relationship with the feeding roller 8 for removing paper dust from the sheets being fed by the feeding roller 8.

The pair of registration rollers 12 disposed downstream of the paper dust roller 50 function to correct misalignment in the sheets of paper conveyed along the paper-conveying path. This is accomplished with a position sensor 64 disposed near the feeding roller 8 for detecting the paper, and a controller (not shown) for controlling when the registration rollers 12 are driven and halted based on the detection timing of the position sensor 64. Specifically, the control device drives the registration rollers 12 when paper is conveyed by the feeding roller 8 and halts the registration rollers 12 when the position sensor 64 detects the leading edge of the paper. After the paper contacts the registration rollers 12 and becomes slack, the control device begins driving the registration rollers 12 again in order to convey the sheet to the image forming unit 5. The position sensor 64 is a mechanical device that is displaced from a prescribed position when contacted and pushed by the leading edge of the paper.

A manual feed opening 14 is formed in the front of the multifunction device 1 slightly above the feeding roller 8 for directly feeding paper to the position of the registration rollers 12 through the front of the multifunction device 1 so that paper can be supplied onto the conveying path without being loaded in the paper cassette 6.

The image forming unit 5 includes a scanning unit 16, the process unit 17, and a fixing unit 18.

The scanning unit 16 is disposed in the top section of the main casing 3 above the process unit 17 described later. The scanning unit 16 includes a laser light-emitting unit (not shown), a polygon mirror 19 that is rotatably disposed, a polygon motor 25 for driving the polygon mirror 19 to rotate, lenses 20 and 21, reflecting mirrors 22 and 23, and the like. The laser light source emits a laser beam that passes through or is reflected by the polygon mirror 19, lens 20, reflecting mirror 22, lens 21, and reflecting mirror 23 in the order given along a path indicated by alternating dots and dashes in FIG. 5. The laser beam is irradiated in a high-speed scan over the surface of the photosensitive drum 27 in the process unit 17.

The process unit 17 is detachably mounted in the main casing 3 through a front surface 1*b* of the multifunction device 1. The process unit 17 includes a drum cartridge 26 and a developer cartridge 28. The mounting operation of the process unit 17 will be described below.

Figure 6:
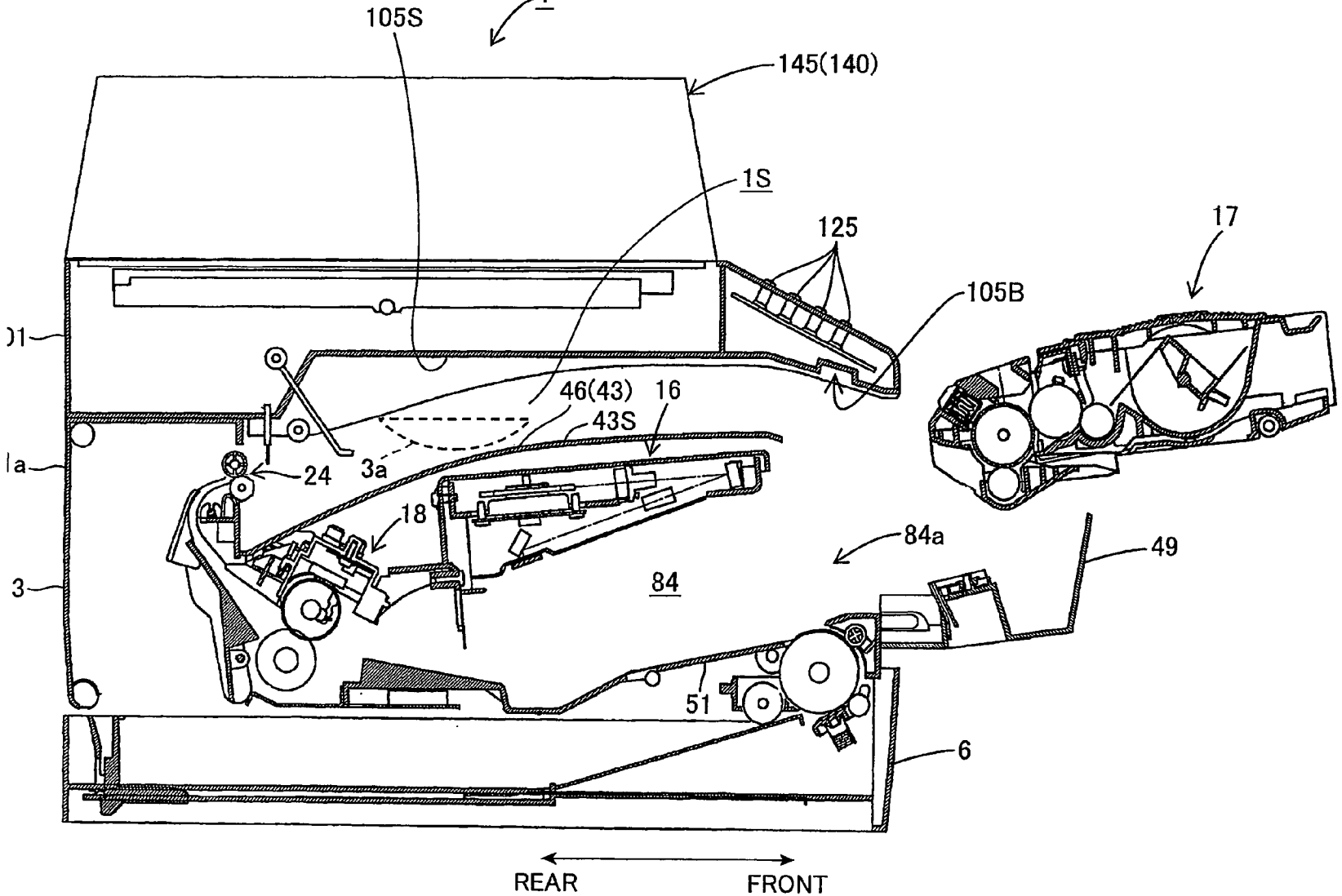
FIG. 6 is a vertical cross-sectional view of the multifunction device for particularly showing a process unit in a detached state.

FIG. 6 is a cross-sectional view of the multifunction device 1 showing the process unit 17 in a detached state. As shown in FIG. 6, an accommodating section 84 is formed in the main casing 3 between the scanning unit 16 and the paper cassette 6 for accommodating the process unit 17. An opening 84*a* in fluid communication with the accommodating section 84 is formed in the front surface 1*b* of the main casing 3. A front cover 49 is attached to the lower edge of the opening 84*a* by hinges (not shown). The front cover 49 can be pivotally moved about the hinges between a horizontal position that reveals the opening 84*a* (the position shown in FIG. 6) and a vertical position that covers the opening 84*a* (the position shown in FIG. 5). Consequently, the process unit 17 can be inserted into the accommodating section 84 or removed from the accommodating section 84 via the opening 84*a* when the front cover 49 is set to the horizontal position.

As shown in FIG. 5, the drum cartridge 26 of the process unit 17 includes the photosensitive drum 27, a Scorotron charger 29, and a transfer roller 30. The developer cartridge 28 of the process unit 17 includes a developer roller 31, and a toner box 34. The developer cartridge 28 is detachably mounted on the drum cartridge 26.

The toner box 34 is filled with a toner. A rotational shaft 35 is disposed in the center of the toner box 34. An agitator 36 is provided on the rotational shaft 35 and is capable of rotating in a direction indicated by the arrow (clockwise in FIG. 5). A toner supply opening 37 is formed in the rear side of the toner box 34. The rotating agitator 36 stirs the toner in the toner box 34, discharging some of the toner through the toner supply opening 37.

A toner supply roller 33 is disposed at a position on the rear side of the toner supply opening 37 and is capable of rotating in the counterclockwise direction in FIG. 1. The developer roller 31 is disposed in confrontation with the toner supply roller 33 and is also capable of rotating in the counterclockwise direction. The developer roller 31 and toner supply roller 33 contact each other with pressure so that each is compressed to a degree.

A thickness-regulating blade 32 is disposed near the developer roller 31. The thickness-regulating blade 32 is configured of a main blade member formed of a metal leaf spring member, and a pressing part 40 provided on the distal end of the main blade member. The pressing part 40 has a semicircular cross-section and is formed of an insulating silicon rubber. The thickness-regulating blade 32 is supported on the developer cartridge 28 near the developer roller 31 so that the elastic force of the main blade member causes the pressing part 40 to contact the developer roller 31 with pressure.

Toner discharged through the toner supply opening 37 by the rotation of the agitator 36 is supplied onto the developer roller 31 by the rotation of the toner supply roller 33. At this time, the toner is positively tribocharged between the toner supply roller 33 and developer roller 31. As the developer roller 31 continues to rotate, the toner supplied onto the surface of the developer roller 31 passes between the pressing part 40 of the thickness-regulating blade 32 and the developer roller 31, at which time the toner is further tribocharged and is smoothed so that a thin layer of uniform thickness is carried on the developer roller 31.

The photosensitive drum 27 is disposed at a position alongside the developer roller 31 and is capable of rotating clockwise in FIG. 1 while in confrontation with the developer roller 31. The photosensitive drum 27 includes a main drum body that is grounded and a surface layer formed of a positive charging photosensitive layer of polycarbonate or the like. A main motor (not shown) generates a motive force for driving the photosensitive drum 27 to rotate.

The Scorotron charger 29 is disposed in opposition to the photosensitive drum 27 but separated a prescribed distance therefrom and is positioned about 30 degrees above the horizontal along a radial direction of the photosensitive drum 27. The Scorotron charger 29 is a positive charging Scorotron charger having a charging wire formed of tungsten or the like from which a corona discharge is generated. The Scorotron charger 29 functions to charge the entire surface of the photosensitive drum 27 with a uniform positive polarity.

As the photosensitive drum 27 rotates, the Scorotron charger 29 charges the surface of the photosensitive drum 27 with a uniform positive polarity. Subsequently, the scanning unit 16 irradiates a laser beam in a high-speed scan to form an electrostatic latent image on the surface of the photosensitive drum 27 based on prescribed image data.

Next, positively charged toner carried on the surface of the developer roller 31 comes into contact with the photosensitive drum 27 as the developer roller 31 rotates and is supplied to areas on the surface of the positively charged photosensitive drum 27 that were exposed to the laser beam and, therefore, have a lower potential. In this way, the latent images on the photosensitive drum 27 are developed into visible images according to a reverse development process.

The transfer roller 30 is rotatably supported in the drum cartridge 26 at a position below the photosensitive drum 27. The transfer roller 30 is capable of rotating in the counterclockwise direction of FIG. 5 while confronting the photosensitive drum 27. The transfer roller 30 is configured of a metal roller shaft covered by a roller that is formed of a rubber material with ionic conductivity. A transfer bias (forward transfer bias) is applied to the transfer roller 30 during a transfer operation. As a consequence, the visible image carried on the surface of the photosensitive drum 27 is transferred onto a sheet of paper passing between the photosensitive drum 27 and the transfer roller 30 (at the image forming position P1).

The fixing unit 18 is disposed downstream of the process unit 17 in the paper-conveying direction (rearward). The fixing unit 18 includes the fixing roller 41, and a pressure roller 42. The fixing roller 41 includes a metal tube, the surface of which has been coated with a fluorocarbon resin, and a halogen lamp disposed inside the metal tube for heating the same. A motor (not shown) inputs a motive force for driving the fixing roller 41 to rotate.

The pressure roller 42 is disposed below and in opposition to the fixing roller 41 and contacts the fixing roller 41 with pressure. The pressure roller 42 is configured of a metal roller shaft covered with a roller that is formed of a rubber material. The pressure roller 42 follows the rotational drive of the fixing roller 41.

Figure 2:
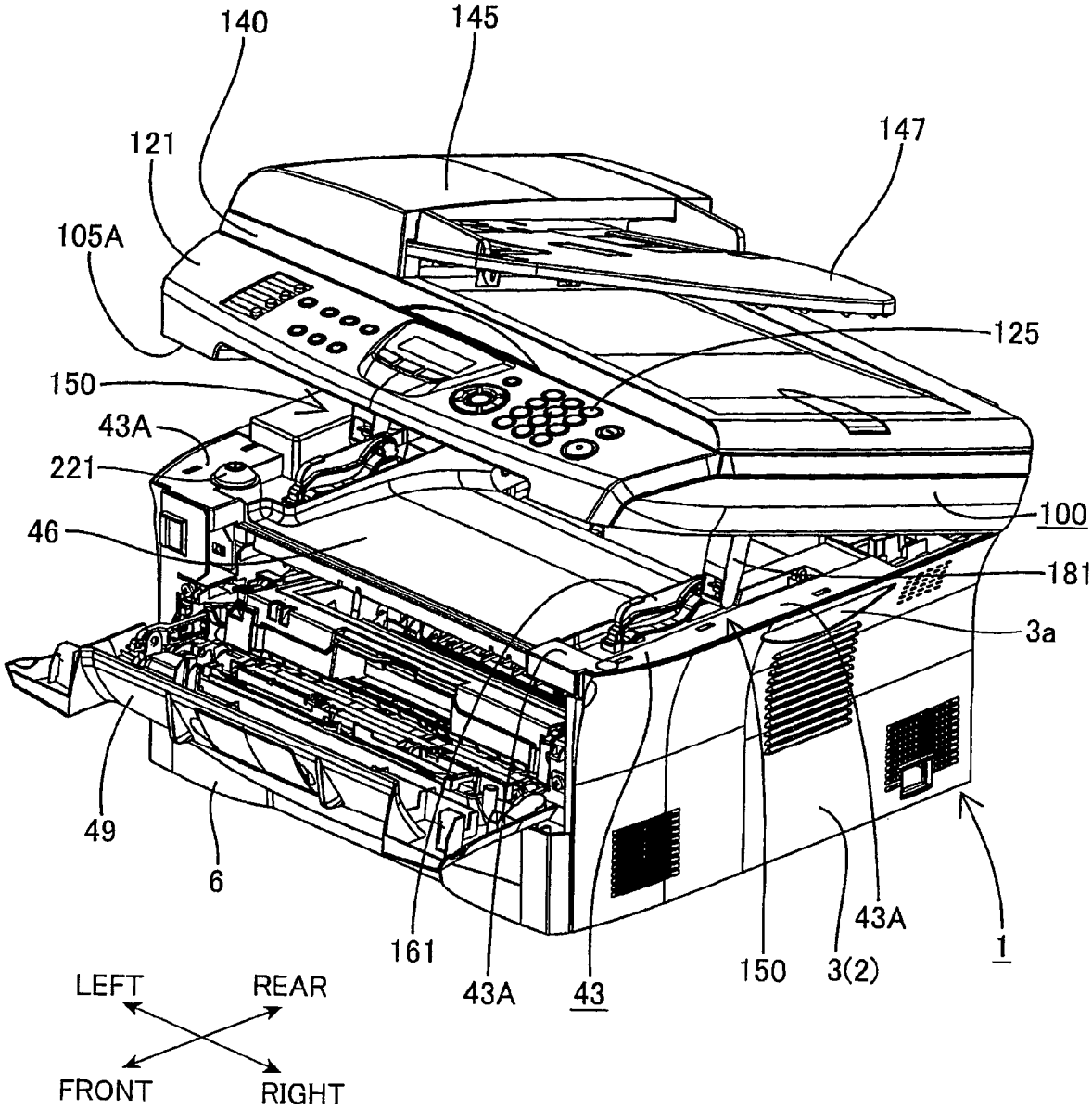
FIG. 2 is a perspective view showing the multifunction device when an image reading unit is in an open position and a front cover is also in an open state.

In the fixing unit 18, toner transferred onto paper at a transfer position between the photosensitive drum 27 and transfer roller 30 is fixed to the paper by heat as the paper passes between the fixing roller 41 and pressure roller 42. After the fixing process, the paper is conveyed along a discharge path toward a top wall 43 of the main casing 3. The discharge path is formed by guide members 52 and 53 and leads from the fixing unit 18 to the top wall 43 of the main casing 3 while reversing the conveying direction toward the front of the main casing 3 (discharge direction). A discharge opening 24 is formed at the top of the discharge path. A pair of discharge rollers 45 is disposed at the top of the discharge path at the discharge opening 24. The discharge tray 46 is provided as a recessed portion in the center of the top wall 43 (FIG. 2). The top wall 43 has a top surface 43S. When a sheet of paper is conveyed along the discharge path from the fixing unit 18, the discharge rollers 45 receive the sheet and discharge the sheet through the discharge opening 24 onto the discharge tray 46.

The discharge tray 46 is formed with a gentle curve in a direction from the rear to the front so that the front portion of the discharge tray 46 drops gradually, forming a paper-retrieving space 82 between the front part of the discharge tray 46 and a bottom wall 105 of the image reading unit 100 described later. The bottom wall 105 has a bottom surface 105S. With this construction, after the multifunction device 1 has formed an image on an A4 size sheet of paper, for example, and discharged the sheet onto the discharge tray 46, the leading edge of the sheet projects into the paper-retrieving space 82. Accordingly, an operator can easily retrieve the sheet by reaching into the paper-retrieving space 82.

As shown in FIG. 6, a discharged-sheet accommodating space 1S for accommodating discharged sheets of paper is formed between the discharge tray 46 and the bottom surface 105S of the upper casing 101. The discharged-sheet accommodating space 1S is located between the right-side and left-side handles 3*a*. In other words, a straight line connecting the right-side and left-side handles 3*a* passes through the discharged-sheet accommodating space 1S. In other words, the right-side and left-side handles 3*a* are located at positions where the discharged-sheet accommodating space 1S is extended in the right and left directions. Because the handles 3*a* are provided at these positions, when a user holds up the multifunction device 1, the user's hands naturally hold both the handles 3*a* and the image reading unit 100. Thus, the image reading unit 100 can be prevented from opening inadvertently.

Image Reading Unit

The image reading unit 100 is a flatbed type scanner. As shown in FIG. 5, the image reading unit 100 is disposed above and in confrontation with the discharge tray 46. The image reading unit 100 includes an upper casing 101 (image-reading-unit casing) that can cover the top surface of the discharge tray 46. The upper casing 101 is substantially shaped like a box with an open top. The top of the upper casing 101 is sealed by a platen glass 107 (document support member) for supporting original documents to be scanned, and an image sensor 115 is accommodated in the upper casing 101. The image sensor 115 is a line type sensor extending in the front-to-rear direction. A guide shaft 117 is provided for supporting the image sensor 115 so that the image sensor 115 can move reciprocatingly along the guide shaft 117 in the left-to-right direction of the multifunction device 1 (a direction perpendicular to the surface of the drawing).

A plurality of photodiodes (not shown) is arranged on the image sensor 115 along the direction in which the image sensor 115 extends. The individual photodiodes receive reflected light when a light source (not shown) irradiates a strong light on the document. The image sensor 115 converts the intensity (brightness) of the reflected light for each pixel of the document to electric signals. By converting these signals to digital data with an A/D converter (not shown), the image reading unit 100 can read the image formed on the document as image data. A static-eliminating brush 135 is disposed on the bottom wall 105 of the upper casing 101 at a position near the rear end. The static-eliminating brush 135 has a holder part 135*b* mounted on the bottom wall 105, and a brush part 135*a* held by the holder part 135*b*. The brush part 135*a* is positioned to contact or approach paper discharged through the discharge opening 24 across the entire width of the paper.

As shown in FIG. 1, the image reading unit 100 includes a control panel 121 and a document cover 140. The control panel 121 is positioned on the front side and includes a touch panel 125 for performing operations. The document cover 140 is disposed on top of the upper casing 101 and includes an automatic document feeder (ADF) 145.

Figure 3:
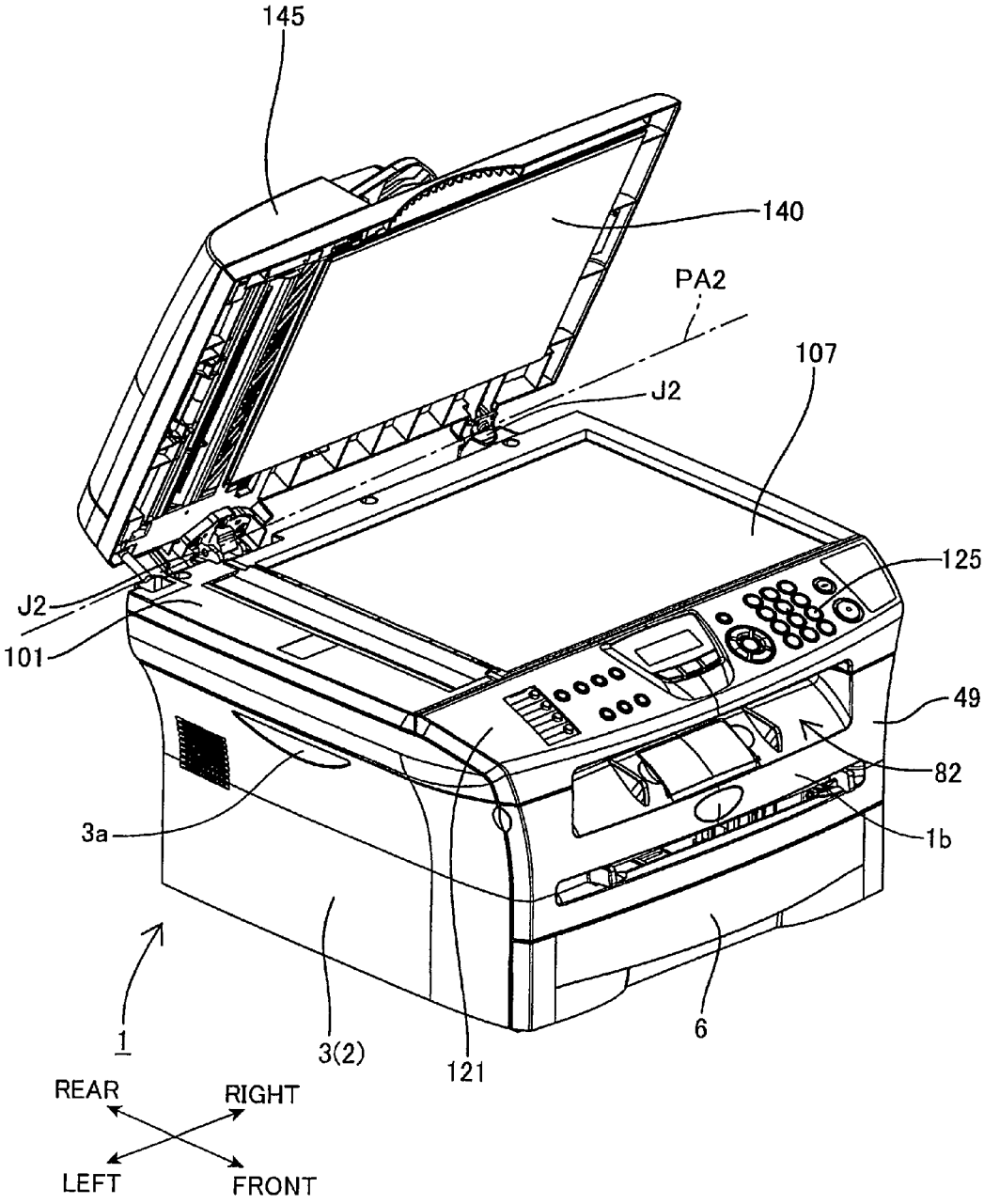
FIG. 3 is a perspective view showing the multifunction device when a document cover is in an open state.

FIG. 3 is a perspective view showing the multifunction device 1 when the document cover 140 is open. The document cover 140 is formed sufficiently large to cover the top surface of the platen glass 107 and is pivotally supported at the upper casing 101 by second hinges J2 provided on the top surface of the upper casing 101 near the rear end thereof. With this construction, the document cover 140 is pivotally movable about a second pivoting axis PA2.

With this construction, the document cover 140 is normally positioned to cover the top of the platen glass 107. However, to place a document on the platen glass 107, the front side of the document cover 140 is lifted to pivotally move the document cover 140 about the second pivoting axis PA2, thereby exposing the platen glass 107. While the ADF 145 will not be described in detail, an original document tray 147 (FIG. 4) is disposed on the ADF 145 for supporting an original document. The ADF 145 takes in the document from the original document tray 147 one sheet at a time and conveys the sheets over the image sensor 115, which reads the image from the document while remaining motionless.

Coupling Structure of the Image Reading Unit and the Image Forming Unit

Figure 4:
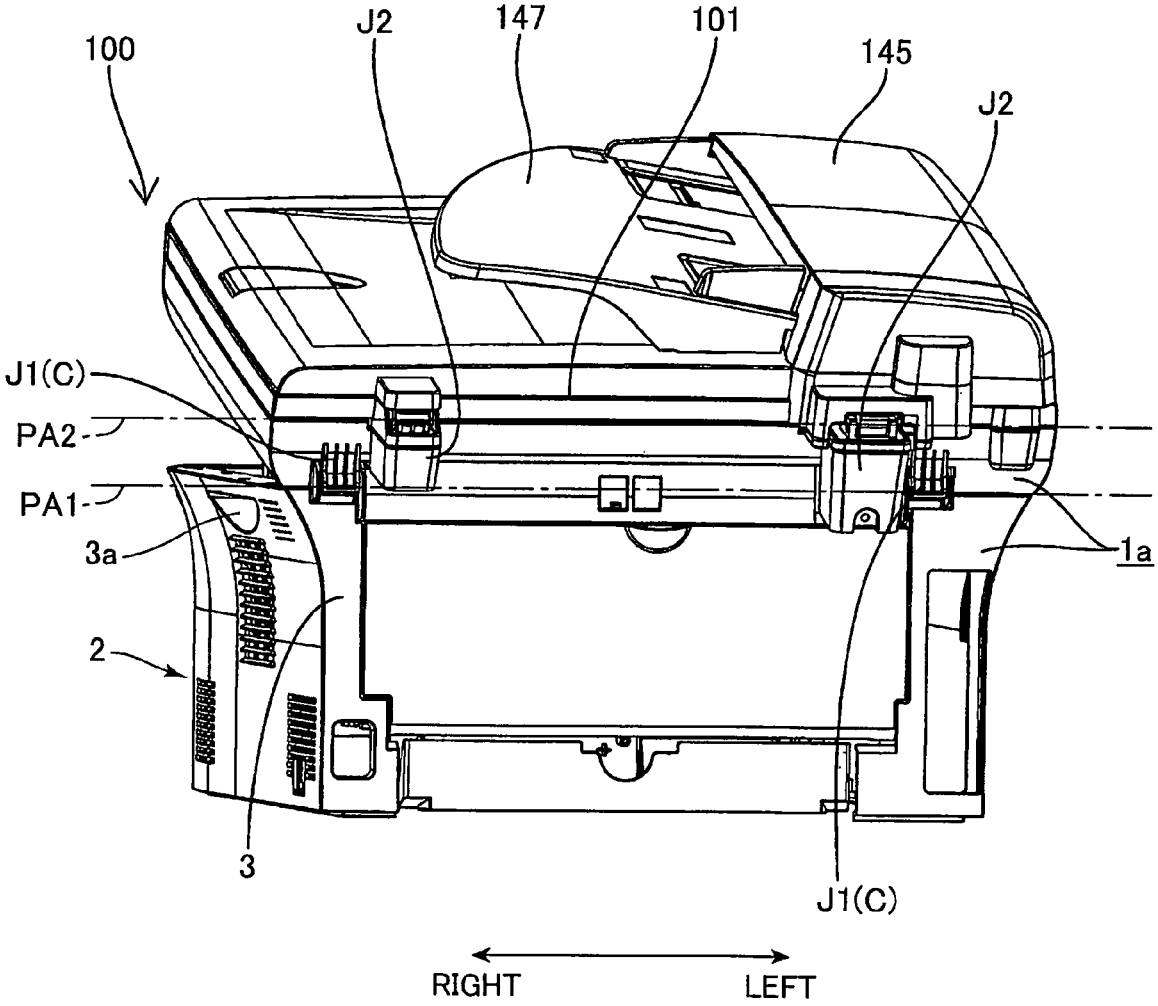
FIG. 4 is a perspective view of the multifunction device from the rear.

FIG. 2 is a perspective view of the multifunction device 1 showing the image reading unit 100 in an open position. FIG. 4 is a perspective view of the multifunction device 1 from the rear. As shown in FIG. 4, the multifunction device 1 has a rear surface 1*a*. The image reading unit 100 is pivotally coupled to the image forming unit 2 by coupling parts C configured of a pair of first hinges J1. Thus the image reading unit 100 can pivotally move about a first pivoting axis PA1. More specifically, the first hinges J1 are provided on the rear surface 1*a* and near the left and right sides thereof, in areas where the upper casing 101 meets the main casing 3. The second hinges J2 are positioned above the first hinges J1 and are further inward in the left-to-right direction. The first pivoting axis PA1 and the second pivoting axis PA2 extend parallel to each other in the left-to-right direction of the drawing. In other words, the second pivoting axis PA2 is positioned farther from the image forming unit 2 than the first pivoting axis PA1 is.

As shown in FIG. 5, a grip part 105B for performing an operation to pivotally move the image reading unit 100 is formed in the bottom wall 105 of the upper casing 101 in the region below the control panel 121 as a protrusion into the upper casing 101. With this construction, as shown in FIG. 5, the image reading unit 100 is normally in a closed position that covers the paper-retrieving space 82, so that the upper casing 101 is substantially level. However, if the user grips the grip part 105B and lifts upward, the control panel 121 end (free end) of the image reading unit 100 pivotally moves upward about the first pivoting axis PA1 so that the image reading unit 100 is in an open position (shown in FIG. 2) in which the top surface of the discharge tray 46 is exposed.

As shown in FIG. 5, by disposing the first hinges J1 on the rear side of the multifunction device 1, the first hinges J1 are positioned upstream of the discharge tray 46 with respect to the paper discharging direction. With this construction, a gap between the image forming unit 2 and the image reading unit 100 at the front end of the discharge tray 46, that is, in the paper-retrieving space 82 can be expanded by pivotally moving the image reading unit 100 open about the first pivoting axis PA1. Accordingly, paper can be easily retrieved after undergoing image formation.

The top surface 43S of the main casing 3 and the bottom surface 105S of the upper casing 101 are confronting surfaces of the image forming unit 2 and the image reading unit 100, respectively. As shown in FIG. 2, flat receiving surfaces 43A and 105A are disposed around the periphery of the top surface 43S and the bottom surface 105S, respectively. More specifically, the receiving surfaces 43A and 105A are provided at the entire left and right ends of the main casing 3 and the upper casing 101, respectively, as well as at the front end excluding the region in which the discharge tray 46 is provided. The receiving surface 43A and the receiving surface 105A contact each other when the image reading unit 100 is in the closed position.

Figure 14:
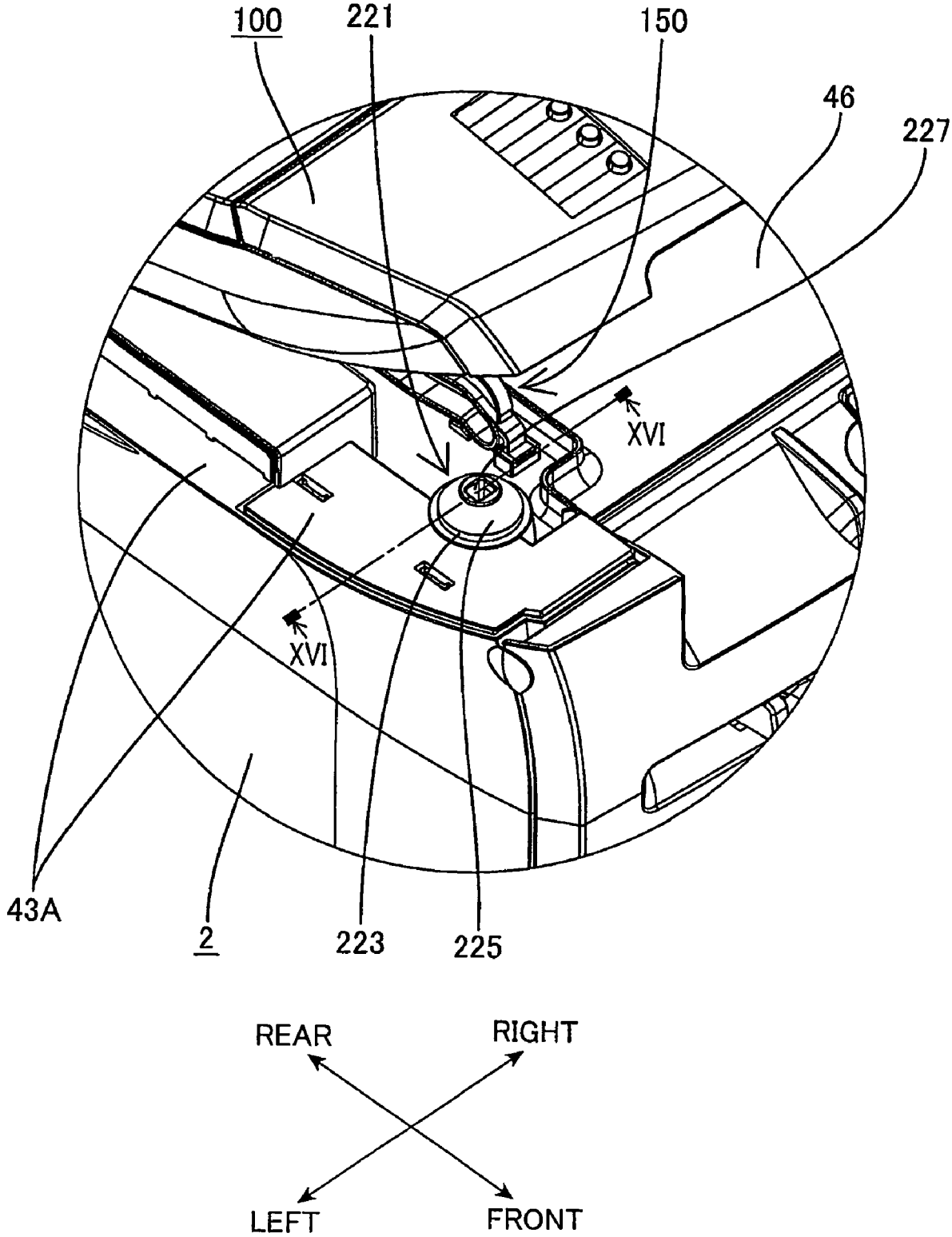
FIG. 14 is an enlarged perspective view showing a confronting surface on a main casing side.
Figure 15:
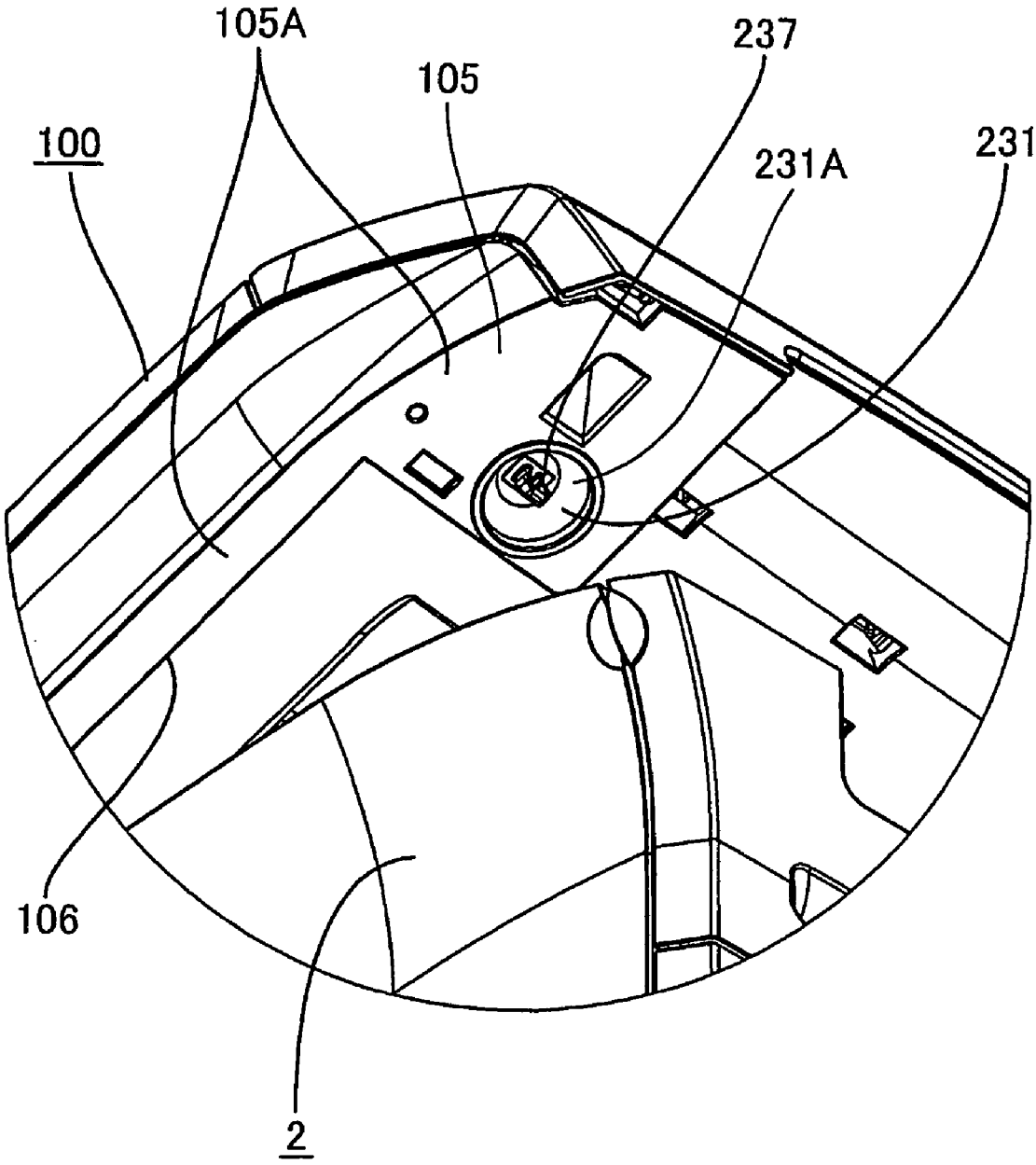
FIG. 15 is an enlarged perspective view showing another confronting surface on an upper casing side.

This construction improves safety by reducing the force applied between the image forming unit 2 and image reading unit 100 should the operator's finger become pinched therebetween. As shown in FIGS. 14 and 15, the width of the receiving surface 43A and receiving surface 105A in the left-to-right direction are wider near the front than the left and right sides of the multifunction device 1 because the gap between the image forming unit 2 and the image reading unit 100 when the image reading unit 100 is in the open position is wider near the front of the multifunction device 1 than the rear thereof. Therefore, the operator is more likely to pinch a finger between the image forming unit 2 and the image reading unit 100 on the front side.

Pivoting-Restricting Member

Next, pivoting-restricting members 150 will be described. As shown in FIG. 2, the pivoting-restricting members 150 are disposed on the image forming unit 2 and the image reading unit 100 at different positions than the first hinges J1. The pivoting-restricting members 150 are provided one on each of the left and right sides of the multifunction device 1 to support the image reading unit 100 at both sides. Since the left and right pivoting-restricting members 150 are mirror images of each other, only the pivoting-restricting member 150 on the right side (on the near side in FIG. 2) will be described.

Figure 7:
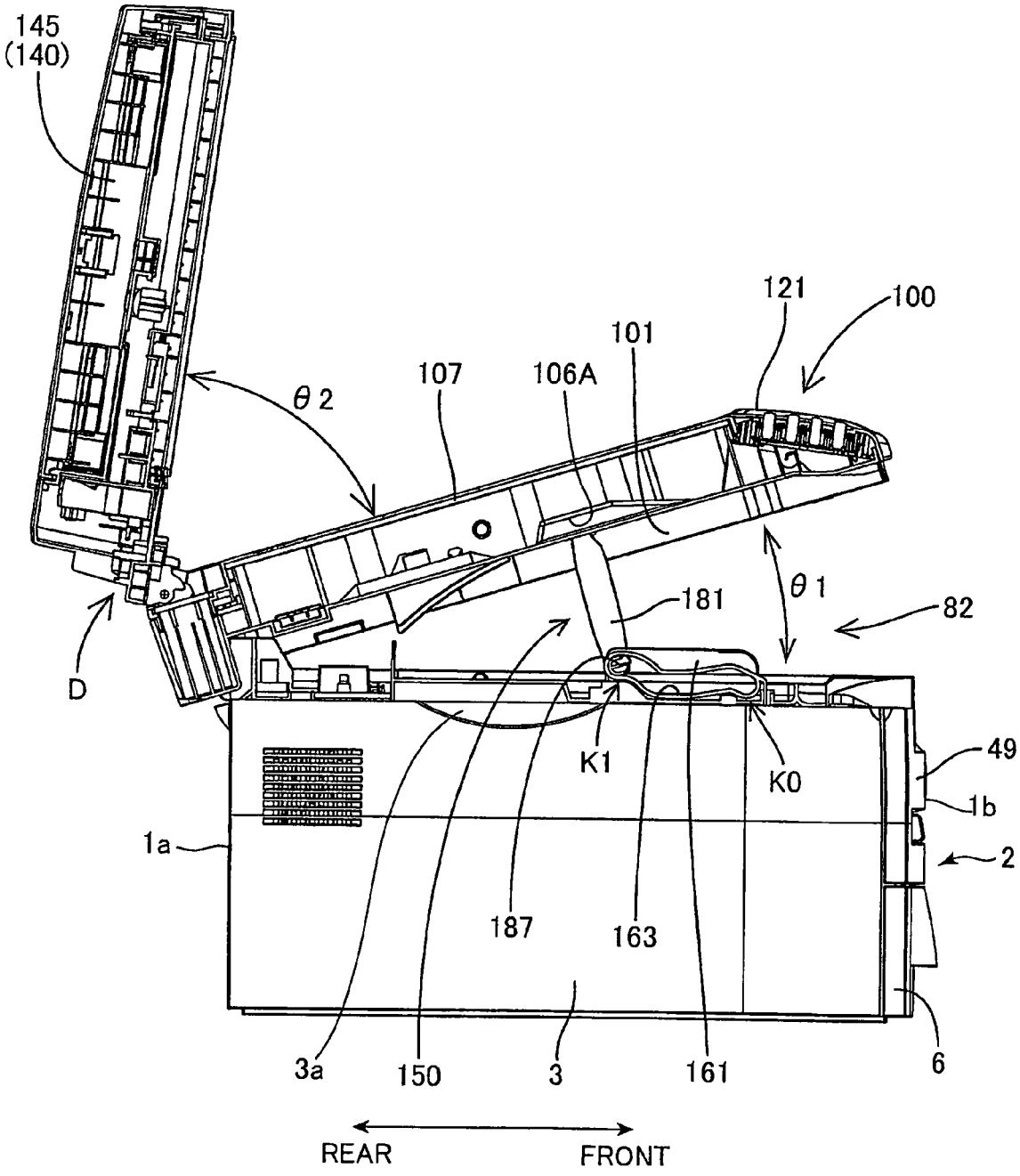
FIG. 7 is a side view of the multifunction device showing both the document cover and an upper casing in an open state.
Figure 8:
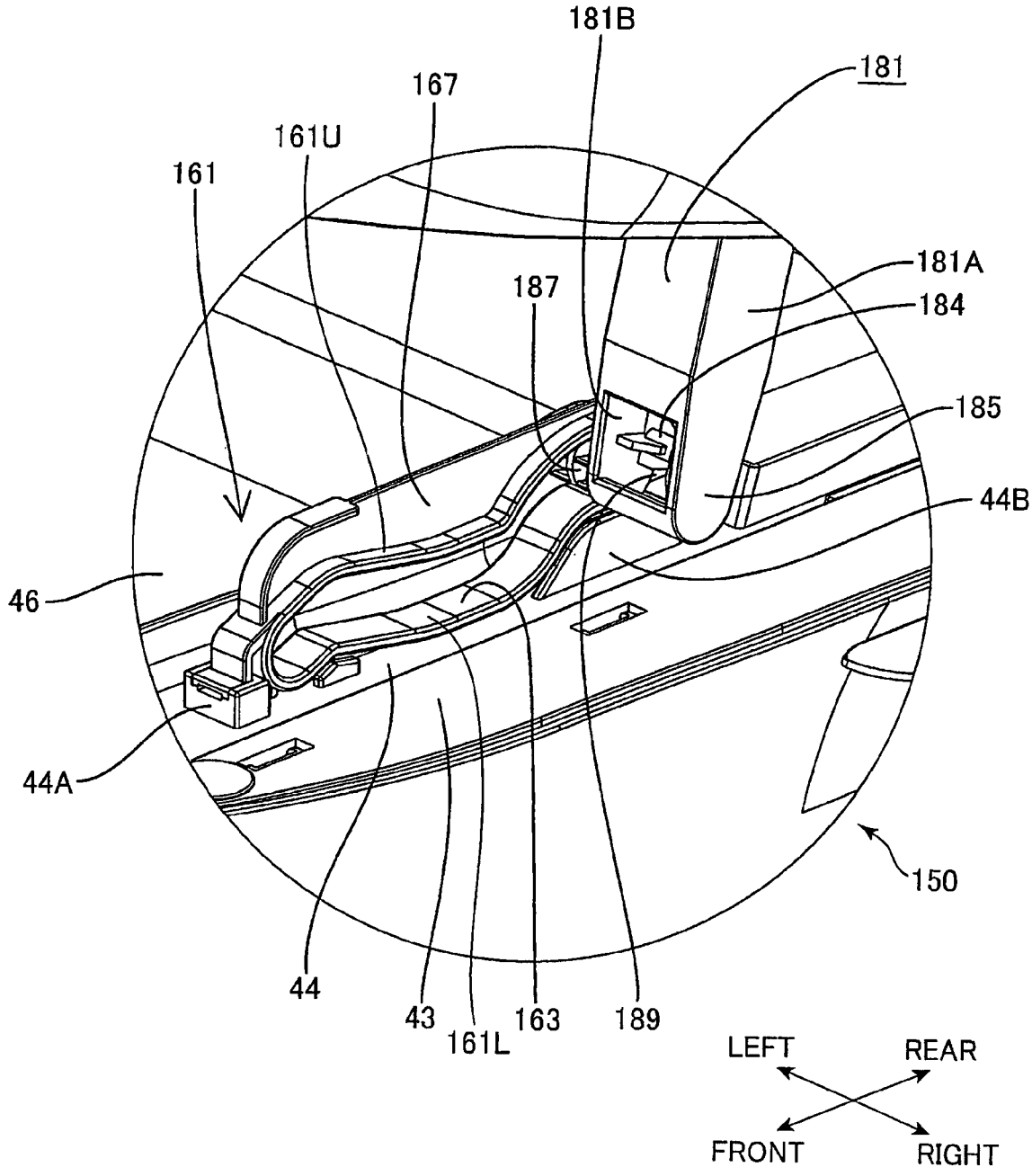
FIG. 8 is an enlarged perspective view of a pivoting-restricting member.
Figure 9:
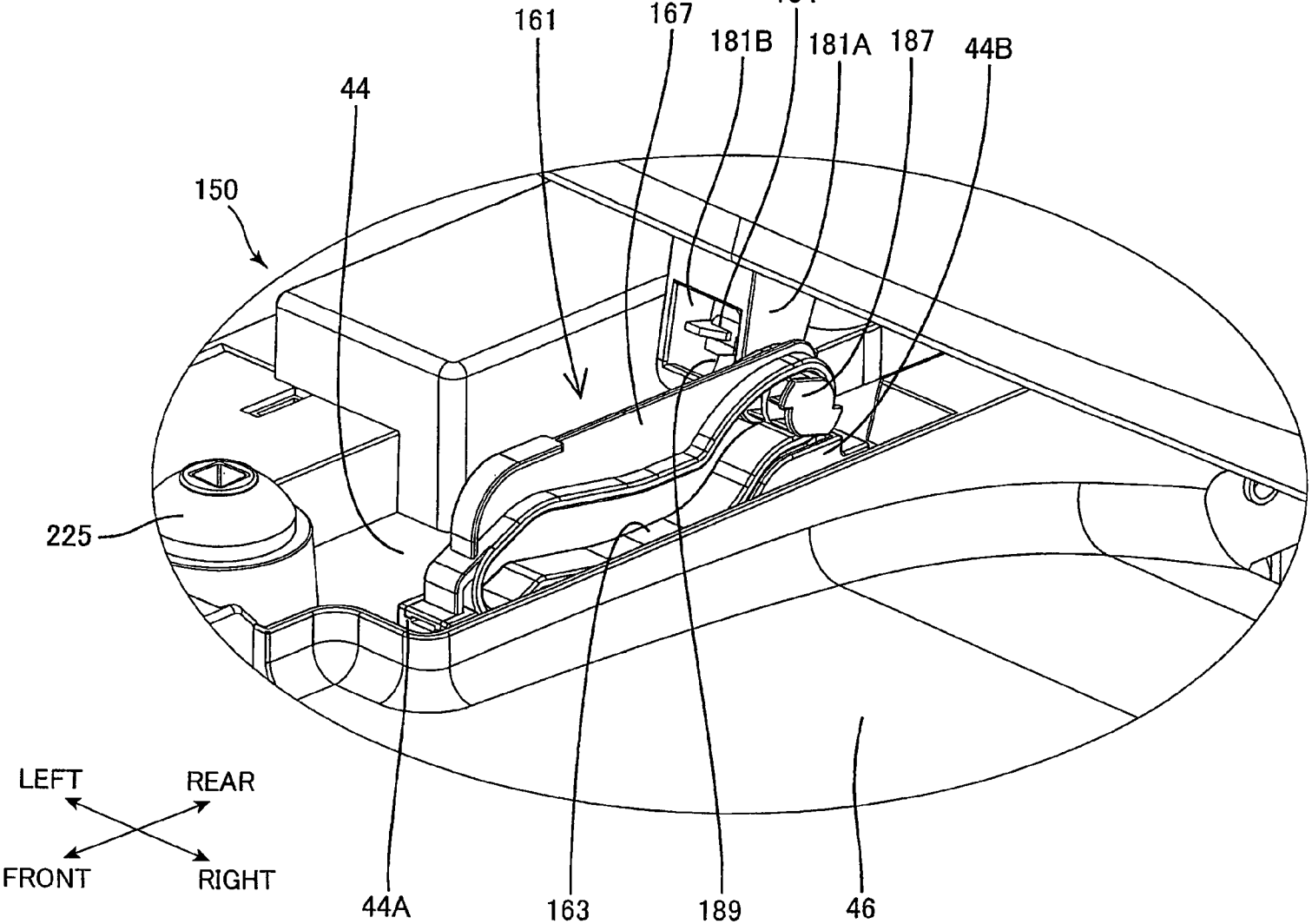
FIG. 9 is an enlarged perspective view of another pivoting-restricting member on the other side from the pivoting-restricting member in FIG. 8.
Figure 10:
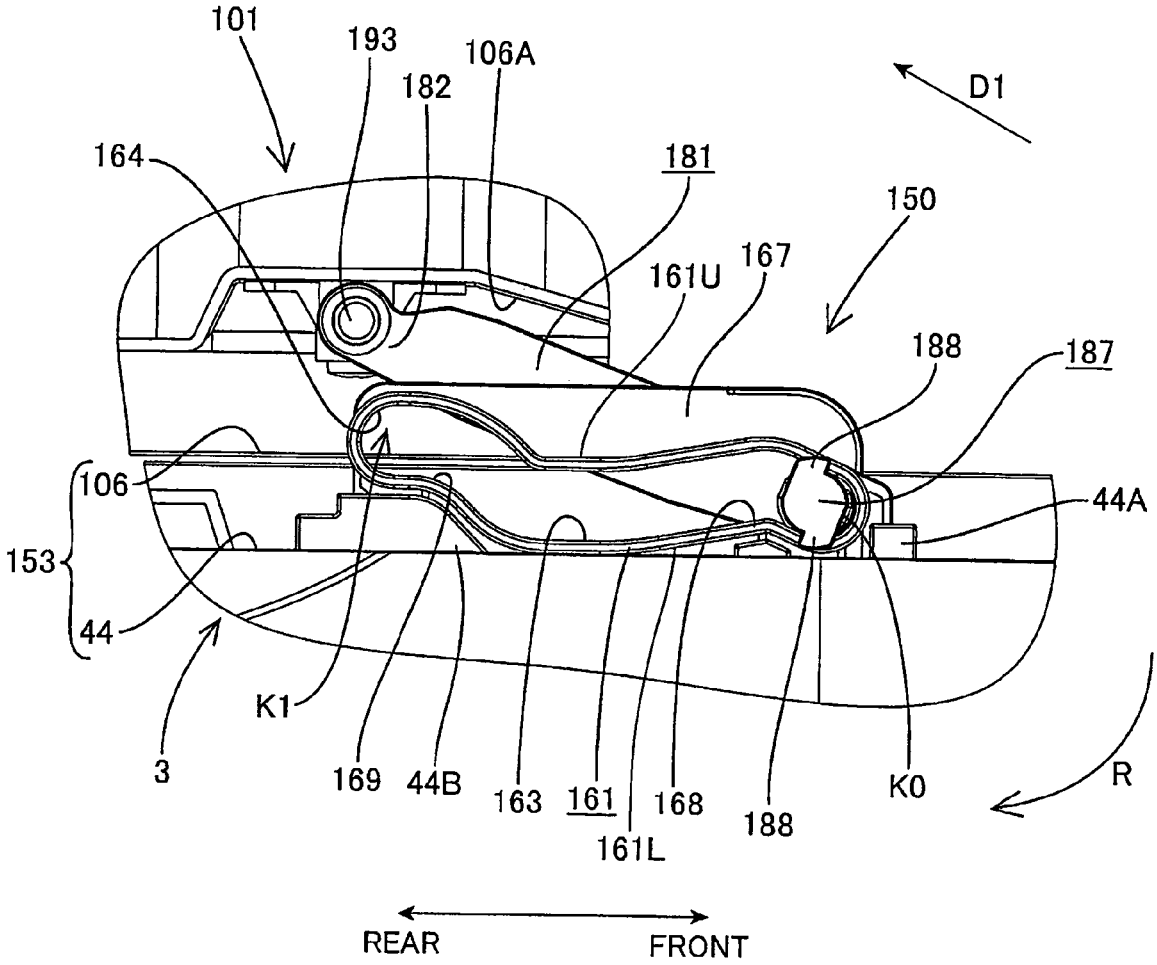
FIG. 10 is a side view of the pivoting-restricting member showing relationship between a coupling link and a guiding groove when the image reading unit is in the closed position.
Figure 11:
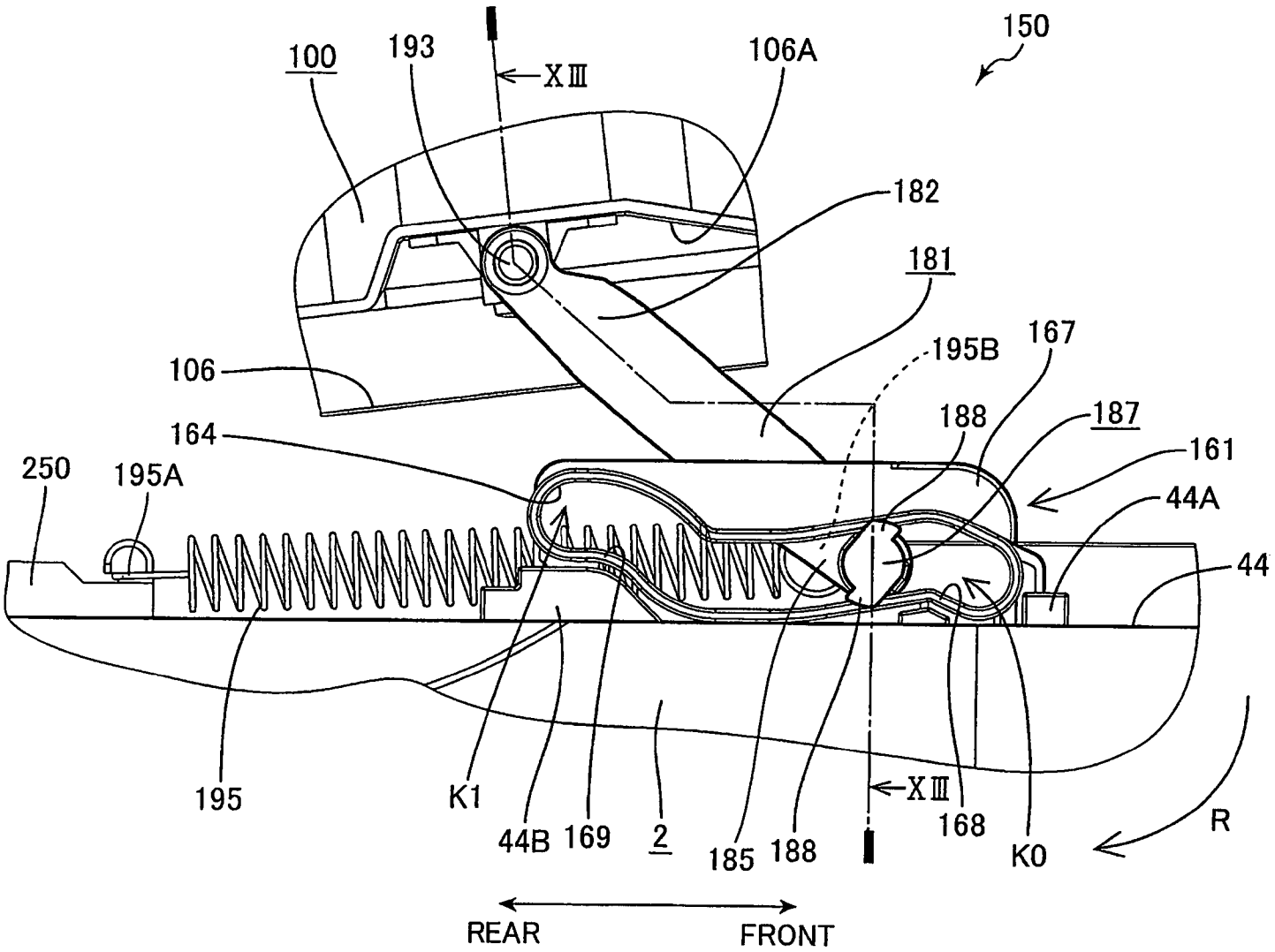
FIG. 11 is a side view of the pivoting-restricting member showing movement of a protrusion along the guiding groove.
Figure 12:
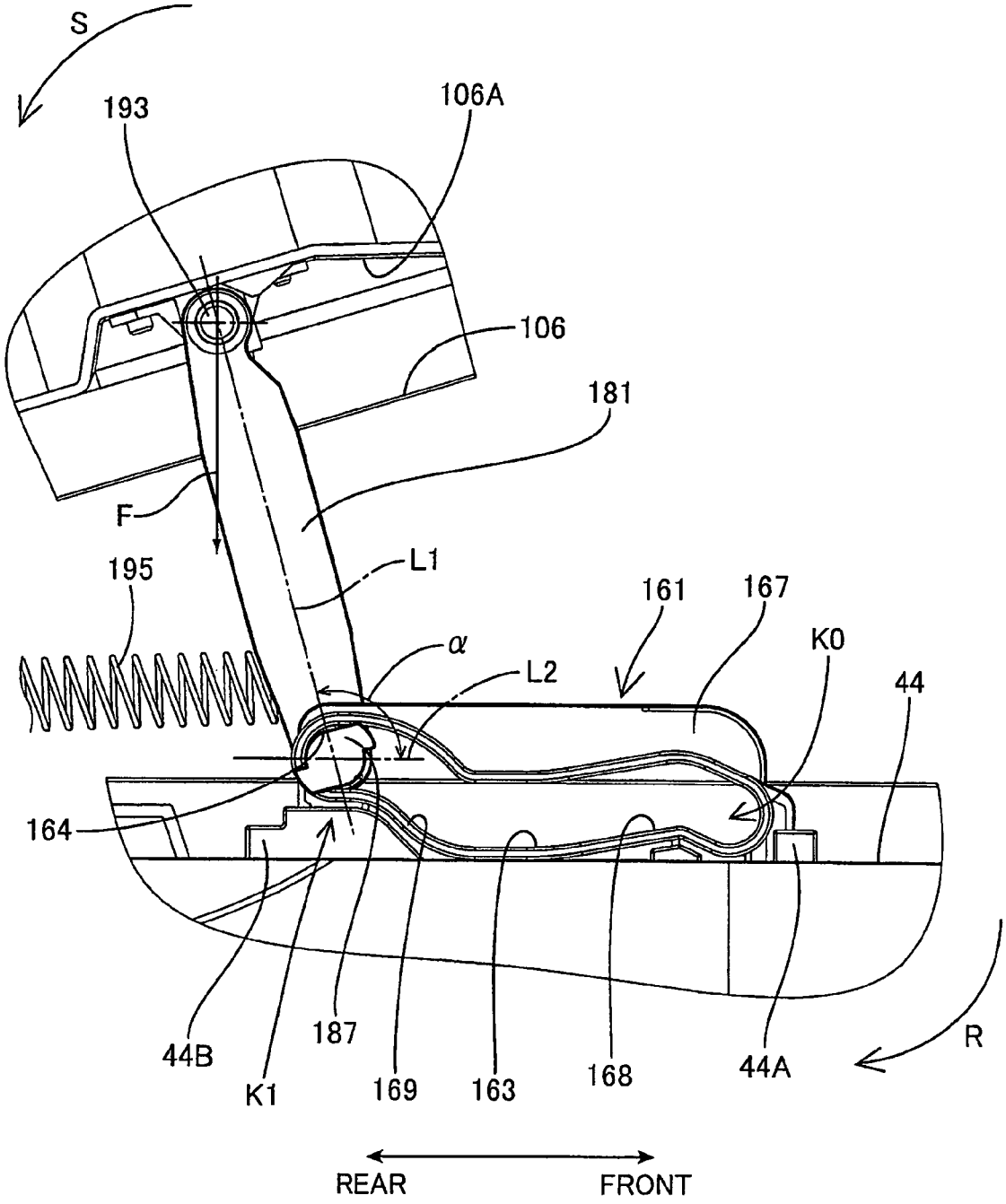
FIG. 12 is a side view of the pivoting-restricting member showing relationship between the coupling link and the guiding groove when the image reading unit is in the open position.
Figure 13:
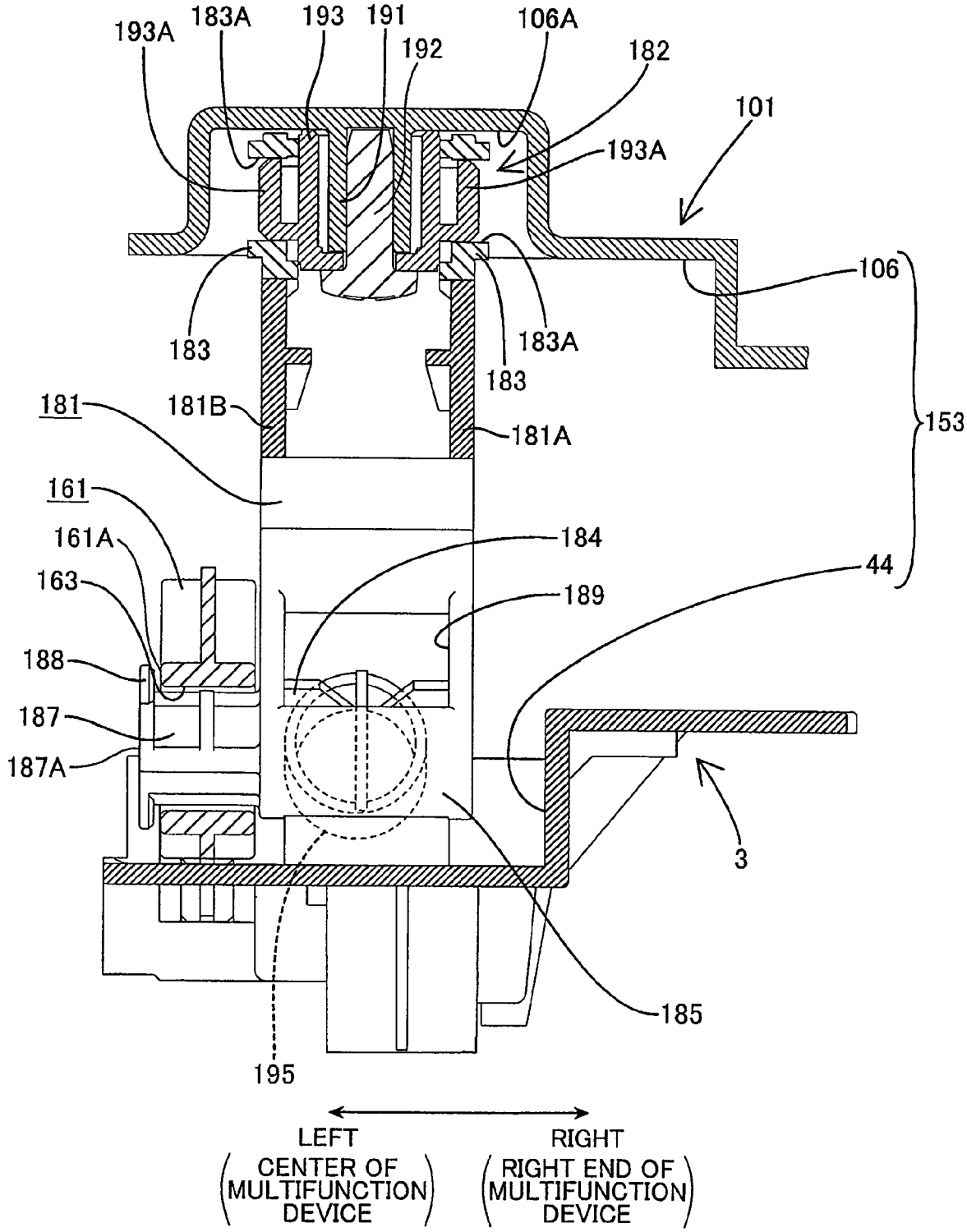
FIG. 13 is a cross-sectional view taken along a line XIII-XIII in FIG. 11 showing a mounting structure of the coupling link.

FIG. 7 is a side view of the multifunction device 1 showing both the document cover 140 and the upper casing 101 in an open state, with the upper section down to where the image reading unit 100 meets the image forming unit 2 shown as a cross-sectional view. FIG. 8 is an enlarged perspective view of the pivoting-restricting member 150 on the right side (FIG. 2). FIG. 9 is also an enlarged perspective view of the pivoting-restricting member 150 in the left side (FIG. 2). FIG. 10 is a side view of the pivoting-restricting member 150 showing the relationship between a coupling link and a guiding groove when the image reading unit 100 is in the closed position. FIG. 11 is a side view of the pivoting-restricting member 150 showing the movement of a protrusion along the guiding groove. FIG. 12 is a side view of the pivoting-restricting member 150 showing the relationship between the coupling link and the guiding groove when the image reading unit 100 is in the open position. FIG. 13 is a cross-sectional view taken along the line XIII-XIII in FIG. 11 showing the mounting structure of the coupling link. It should be noted that a coil spring has not been included in FIG. 10 in order to present an unobstructed view of a link-accommodating portion.

The pivoting-restricting member 150 is configured of a holding plate 161 (engaging member) disposed on the top surface 43 of the main casing 3, and a coupling link 181 retained on the bottom wall 105 of the upper casing 101. More specifically, as shown in FIG. 10, a link-accommodating portion 153 is provided on the left and right sides of the discharge tray 46 in the front-to-rear direction. The link-accommodating portion 153 includes an upper-casing-side storing portion 106 formed in the bottom wall 105 of the upper casing 101, and a main-casing-side storing portion 44 formed in the top wall 43 of the main casing 3. An accommodating recessed portion 106A is formed in the upper-casing-side storing portion 106.

As shown in FIG. 13, a mounting piece 191 having a screw hole protrudes downward from the center part of the recessed portion 106A. A support shaft 193 is fixed to the mounting piece 191 by a screw 192. The support shaft 193 has a pair of support protrusions 193A, one each on the left and right sides of the support shaft 193, protruding outward. One end of the coupling link 181 is connected to the support protrusions 193A.

The coupling link 181 is formed of a synthetic resin and has a squared C-shaped cross-section. The coupling link 181 includes an upper end 182, and a metal shaft coupling part 183 integrally provided with the upper end 182. The shaft coupling part 183 has shaft holes 183A that penetrate through the left and right surfaces of the shaft coupling part 183. The shaft coupling part 183 is made of metal.

The support shaft 193 fits into the shaft coupling part 183 of the coupling link 181 with the support protrusions 193A inserted into the shaft holes 183A. With this construction, the coupling link 181 is pivotally supported around the support shaft 193. The edges of the shaft holes 183A in the coupling link 181 can be subjected to a burring process to expand the surface area in contact with the support protrusions 193A. This construction can ensure that the coupling link 181 pivotally moves smoothly about the support protrusions 193A.

The coupling link 181 also has a lower end 185 on the opposite end from the upper end 182. A protrusion 187 is provided on the side of the lower end 185 and protrudes toward the center of the multifunction device 1 (leftward in FIG. 13). The protrusion 187 is shaped to fit into a guiding groove 163 formed in the holding plate 161 to be described later.

The coupling link 181 includes side walls 181A and 181B. A connecting piece 184 (FIGS. 8 and 9) and a spring mounting hole 189 between the side wall 181A and side wall 181B at a position near the lower end 185 but slightly above the protrusion 187. The connecting piece 184 increases the rigidity of the coupling link 181 around the protrusion 187 to prevent twisting.

A mounting anchor 250 (FIG. 11) is provided on the main casing 3. A coil spring 195 is disposed in the spring mounting hole 189 (FIG. 9) with one end 195A fixed to the mounting anchor 250 and another end 195B fixed to the lower end 185 of the coupling link 181. The coil spring 195 extends along the front-to-rear direction of the multifunction device 1 and urges the lower end 185 toward the rear.

As shown in FIG. 13, the protrusion 187 is inserted through the guiding groove 163 in a horizontal direction (from the right end toward the center of the multifunction device 1) such that a protruding end 187A of the protrusion 187 protrudes from the guiding groove 163. Retaining portions 188 are provided on the protruding end 187A of the protrusion 187.

The retaining portions 188 protrude outward in a direction perpendicular to the insertion direction of the protrusion 187 and confront a side surface 161A of the holding plate 161, thereby functioning to prevent the protrusion 187 from being pulled out of the guiding groove 163. As shown in FIG. 10, the retaining portions 188 are not provided around the entire periphery of the protrusion 187, but only on the upper and lower sides. With this construction, the protrusion 187 can easily be inserted into the guiding groove 163 by twisting the retaining portions 188 sideways along the guiding groove 163.

Next, the holding plate 161 will be described. As shown in FIGS. 8 and 9, a pair of front and rear seat portions 44A and 44B is formed on the main-casing-side storing portion 44 at positions corresponding to the protrusion 187 with respect to the left-to-right direction (i.e., positions farther inward in the multifunction device 1 than the coupling link 181). The holding plate 161 is fixed at front and rear ends to the front and rear seat portions 44A and 44B. The holding plate 161 is formed of a synthetic resin material in an elongated ring shape that extends in the front-to-rear direction with an opening penetrating through the holding plate 161 in the left-to-right direction.

The holding plate 161 is formed integrally of the guiding groove 163 between primarily the upper and lower walls 161U and 161L of the holding plate 161 for receiving the protrusion 187, and a reinforcing piece 167 erected from the top surface of the upper wall 161U in FIGS. 8 and 9. The reinforcing piece 167 is formed along the entire length of the guiding groove 163. The reinforcing piece 167 is formed on the upper wall 161U in this way to improve the durability of the guiding groove 163 since the protrusion 187 slides against the upper wall 161U of the guiding groove 163 when the image reading unit 100 is pivotally moved in the opening and closing directions.

As shown in FIG. 10, the guiding groove 163 generally extends in the front-to-rear direction, with the front end of the guiding groove 163 being an initial position K0 corresponding to the closed position of the image reading unit 100, and the rear end being a restricting position K1 corresponding to the open position of the image reading unit 100. A first sloped portion 168 and a second sloped portion 169 are provided along the path of the holding plate 161 from the initial position K0 to the restricting position K1. The restricting position K1 is provided at the same height as the apex of the second sloped portion 169.

As shown in FIG. 10, when the image reading unit 100 is in the closed position, the protrusion 187 is in the initial position K0. At this time, the coupling link 181 is oriented in a gentle slope that is almost horizontal, and is entirely accommodated in the link-accommodating portion 153.

When the image reading unit 100 is pivotally moved from the closed position to the open position, the support shaft 193 moves together with the image reading unit 100. Specifically, the support shaft 193 is pulled upward and to the rear in a direction D1 in FIG. 10.

However, since the movement of the protrusion 187 is restricted to the path following the guiding groove 16.3 by the upper wall 161U of the holding plate 161, the protrusion 187 moves toward the rear end of the guiding groove 163 (left in FIG. 10). Specifically, beginning from the initial position K0, as shown in FIG. 11, the protrusion 187 first moves up the first sloped portion 168, then moves downward along the guiding groove 163, and finally climbs up the second sloped portion 169. As a result, the coupling link 181 pivotally moves in the direction indicated by an arrow R about the support shaft 193 (FIGS. 10 and 11).

As shown in FIGS. 7 and 12, after the image reading unit 100 has been pivotally moved to the open position, the coupling link 181 is in an erect state (more specifically, slightly tilted from a vertical orientation) at a position closer to the front side of the multifunction device 1 than to the rear side. That is, as shown in FIG. 7, the coupling link 181 is located close to the front side opposite the rear side where the first hinges J1 are located (downstream of the first hinges J1 in the discharge direction) In this way, the top wall 43 of the main casing 3 is linked to the bottom wall 105 of the upper casing 101. At this time, as shown in FIG. 12, the protrusion 187 is positioned in the restricting position K1 of the guiding groove 163.

A groove wall (restricting wall) 164 is positioned in the rear end of the guiding groove 163 to contact the protrusion 187 when the protrusion 187 is in the restricting position K1. Hence, if an operator attempts to pivotally move the image reading unit 100 open farther from the open position, the groove wall 164 restricts movement of the protrusion 187 rearward (in the left direction of FIGS. 7 and 12). With this construction, the image reading unit 100 is restricted from pivotally moving farther open past the open position. The groove wall 164 is formed in an arc shape that follows the outer shape of the protrusion 187 so as to form a surface contact when the protrusion 187 is in contact with the groove wall 164.

In the open position, the image reading unit 100 does not return to the closed position when the operator releases the image reading unit 100, but remains in the open position because the coupling link 181 and coil spring 195 combine to support the weight of the image reading unit 100. More specifically, as shown in FIG. 12, when the image reading unit 100 is in the open position, the weight F of the image reading unit 100 is applied downward on the support shaft 193. This force generates a moment in the coupling link 181 for pivotally moving the coupling link 181 about the protrusion 187 in the direction S, that is, in the restoring direction (closing direction). However, this moment is opposed by the force of the coil spring 195, thereby halting the image reading unit 100 in the open position.

Further, the orientation of the coupling link 181 in the open position is set such that an angle $\alpha$ formed by an axial line L1 of the coupling link 181 connecting the support shaft 193 to the protrusion 187 and a horizontal line L2 is greater than 90 degrees (approximately 110 degrees in the present embodiment). This setting is made with consideration for the following two points.

The first point of consideration is the stability of support fox the image reading unit 100 in the open position. Specifically, the coupling link 181 can prop up the image reading unit 100 more solidly in an erect orientation than in an inclined orientation. Further, since an erect orientation reduces the size of the moment in the S direction shown in FIG. 12, the coil spring 195 need only have a small urging force.

The second point of consideration is the release of the support. In the present embodiment, support of the image reading unit 100 with the coupling link 181 can be released by pushing the image reading unit 100 downward. If consideration were only given for providing stable support, the coupling link 181 could be set in a completely vertical orientation. However, in this case, the support of the coupling link 181 cannot be released by simply pushing down on the image reading unit 100 because the coupling link 181 prop vertically between the image forming unit 2 and the image reading unit 100. Hence, by tilting the coupling link 181 slightly, it is possible to provide stable support and to release the support through a pushing operation.

Since the coupling link 181 pivotally moves from an erect orientation to an inclined orientation gradually while the image reading unit 100 is pivotally moved from the open position to the closed position, the coil spring 195 having the another end 195B fixed to the coupling link 181 is elastically stretched by the pivotal movement, thereby preventing the image reading unit 100 from being closed with great force.

When the image reading unit 100 is in the closed position, the coil spring 195 urges the protrusion 187 toward the restricting position K1. Accordingly, when pivotally moving the image reading unit 100 in the opening direction, the force of the operation in the pivoting direction is supplemented with the force of the coil spring 195, thereby requiring less operational force to open the image reading unit 100 than when the coil spring 195 is not included.

As shown in FIG. 7, an open angle θ1 of the image reading unit 100 to the horizontal is set to about 30 degrees when the image reading unit 100 is in the open position; an open angle θ2 between the document cover 140 and image reading unit 100 when the document cover 140 is opened to the maximum position is set to about 60 degrees; and the sum of both open angles θ1 and θ2 is set to not exceed 90 degrees. This construction reduces the amount that the document cover 140 pivotally moves past the rear surface 1*a* of the main casing 3 (the amount of pivotal movement toward the rear), thereby reducing the amount of space required for installing the multifunction device 1.

Figure 17:
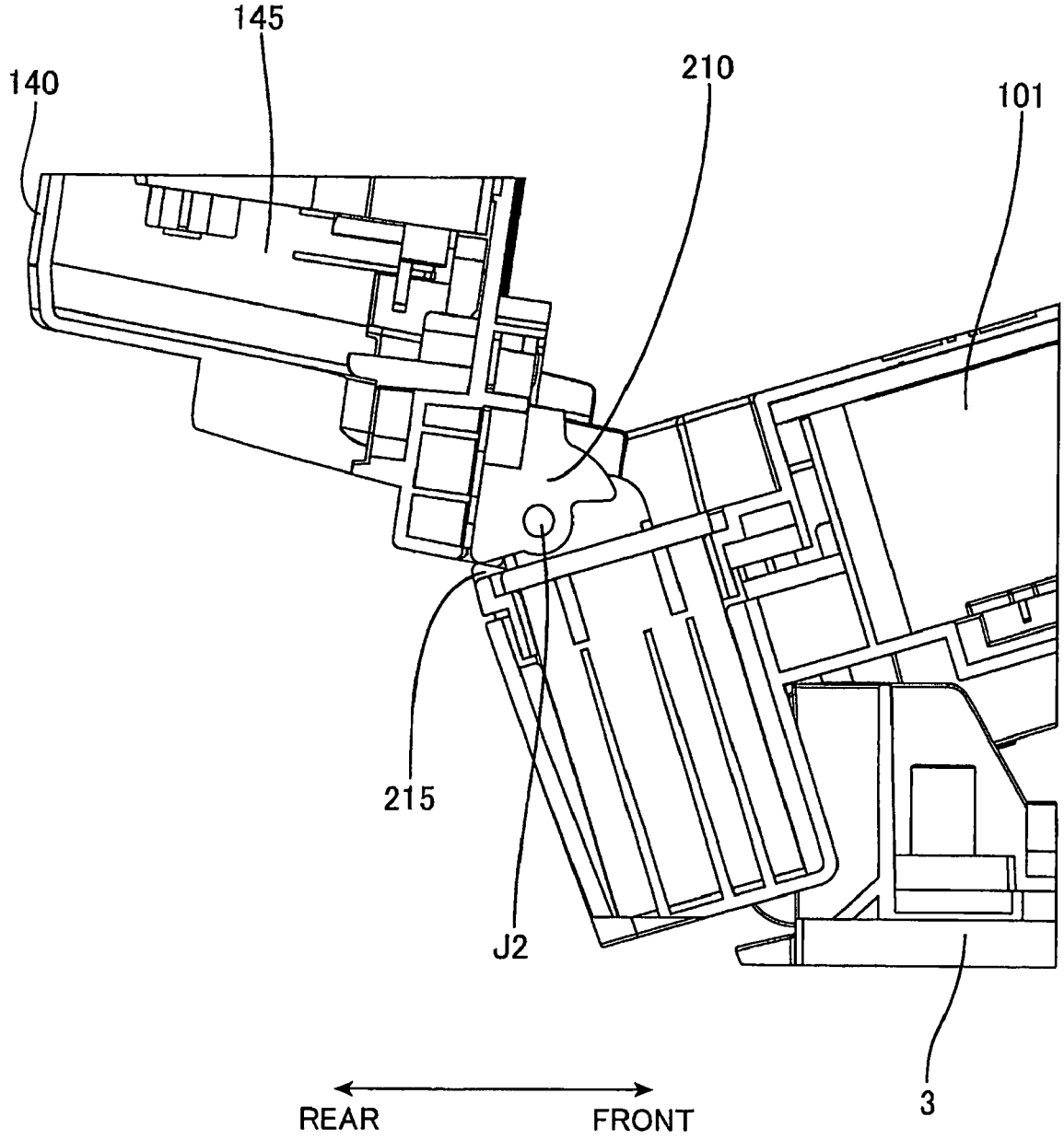
FIG. 17 is an enlarged view of a region near second hinges indicated by a letter D in FIG. 7.

The construction for limiting pivotal movement of the document cover 140 is shown in FIG. 17. FIG. 17 is an enlarged view of the region near the second hinges J2 indicated by the letter D in FIG. 7. As shown in FIG. 17, a stopper bracket 210 is provided on each of the second hinges J2. Striking parts 215 are provided on the rear end of the upper casing 101 at positions corresponding to the stopper brackets 210. Pivotal movement of the document cover 140 is restricted when the stopper brackets 210 contact the striking parts 215.

Figure 16:
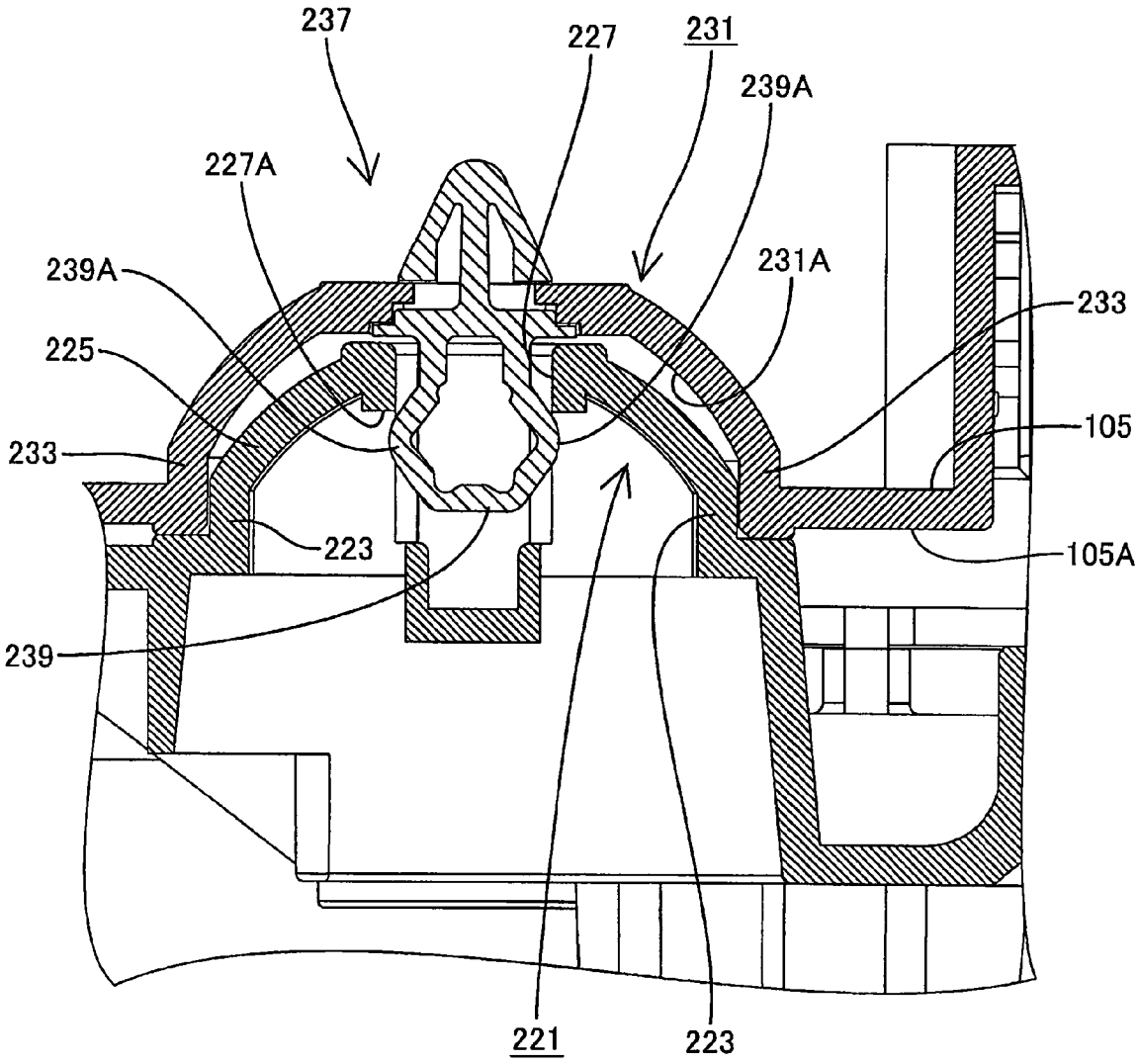
FIG. 16 is a cross-sectional view of the multifunction device taken along a line XVI-XVI in FIG. 14 for particularly showing an elastic holding portion engaged in a locking hole.

Next, mechanisms for preventing the units from opening when in the closed position and for guiding the units to the closed position will be described. FIG. 14 is an enlarged perspective view showing the receiving surface 43A on the main casing 3 side, while FIG. 15 is an enlarged perspective view showing the receiving surface 105A on the upper casing 101 side. FIG. 16 is a cross-sectional view taken along the line XVI-XVI in FIG. 14 showing an elastic holding portion engaged in a locking hole.

As shown in FIG. 14, a semispherical protrusion 221 is provided on the front-left end in the receiving surface 43A. The semispherical protrusion 221 includes a disk-shaped base 223, and a dome-shaped semispherical portion 225 disposed on top of the disk-shaped base 223. A locking hole 227 is formed in the apex of the dome-shaped semispherical portion 225. The peripheral walls of the disk-shaped base 223 are vertical (FIG. 16).

As shown in FIG. 15, a receiving portion 231 is provided on the receiving surface 105A of the bottom wall 105 at a position corresponding to the semispherical protrusion 221. The receiving portion 231 is formed with a concave surface 231A (FIGS. 15 and 16) that substantially follows the curvature of the dome-shaped semispherical portion 225. A locking piece 237 is fixed inside the concave surface 231A (in the receiving portion 231). The locking piece 237 has an elastic holding portion 239 protruding downward (FIG. 16).

As shown in FIG. 16, the elastic holding portion 239 has an overall annular shape and includes a pair of engaging pieces 239A that protrude outward. A guide portion 233 is formed on the bottom portion of the receiving portion 231 for fitting around the disk-shaped base 223 with no space therebetween.

With this construction, when the image reading unit 100 is in the open position, the semispherical protrusion 221 and receiving portion 231 are separated from each other. However, as the image reading unit 100 is pivotally moved to the closed position, the receiving portion 231 begins to gradually cover an upper portion of the semispherical protrusion 221. Subsequently, the image reading unit 100 is guided into the closed position by the guiding effect of the concave surface 231A fitting over the dome-shaped semispherical portion 225.

Further, as the image reading unit 100 is being pivotally moved into the closed position, the elastic holding portion 239 passes through the locking hole 227, with the engaging pieces 239A elastically deforming inward. When the image reading unit 100 arrives in the closed position, the engaging pieces 239A have completely passed through the locking hole 227 and have returned to their original shape. At this time, the engaging pieces 239A engage with an inner wall 227A of the locking hole 227 (FIG. 16).

In this way, the image reading unit 100 is locked to the image forming unit 2 and prevented from moving pivotally in the opening direction. This locking mechanism is particularly effective for preventing the image reading unit 100 from opening when the document cover 140 is opened. Further, when the image reading unit 100 is in a locked state, the guide portion 233 is fitted over the disk-shaped base 223 leaving no space therebetween, thereby restricting horizontal play in the image reading unit 100.

As described above, the semispherical protrusion 221 is formed in a dome shape, and the elastic holding portion 239 is disposed in the concave surface 231A and does not protrude below the bottom surface 105A of the upper casing 101. This construction is an effective safety measure for preventing the operator from pinching a hand or finger between the image forming unit 2 and image reading unit 100, which could occur if the semispherical protrusion 221 was formed with edges or the elastic holding portion 239 protruded lower than the bottom surface 105A.

Next, the operations and effects of the multifunction device 1 in the above-described embodiment will be described. In the multifunction device 1 in the above-described embodiment, the image reading unit 100 is pivotally connected to the image forming unit 2. The space above the discharge tray 46 can be widened by lifting the image reading unit 100 to the open position. By doing so, the operator can easily retrieve paper that has undergone image formation, and particularly paper of a small size such as postcards, from the discharge tray 46 when the leading edge of the paper is not otherwise exposed in the paper-retrieving space 82 (FIG. 5).

Further, if the operator mistakenly attempts to pivotally move the image reading unit 100 farther when the image reading unit 100 is already in the open position or grips and lifts the image reading unit 100 when attempting to move the multifunction device 1, the image reading unit 100 will not pivotally move past the open position due to the pivoting-restricting members 150 that restrict such pivotal movement.

This construction can prevent interference between the image forming unit 2 and image reading unit 100 around the first hinges J1 and interference between the image reading unit 100 and equipment disposed in the periphery of the image reading unit 100. Further, by positioning the coupling links 181 constituting the pivoting-restricting members 150 at positions near the front surface 1*b* of the multifunction device 1, the image reading unit 100 can be more firmly held in the open position than if the pivoting-restricting members 150 were disposed nearer the first hinges J1.

Further, in the above-described embodiment, the first sloped portion 168 and second sloped portion 169 are provided in the guiding groove 163. Thus, the protrusion 187 must slide over the first sloped portion 168 when moving the image reading unit 100 from the open position to the closed position and must slide over the second sloped portion 169 when the image reading unit 100 is moved from the closed position to the open position, thereby slightly increasing the operating force needed near the closed position and the open position.

Accordingly, the construction described above provides the operator with a feeling of restraint as the image reading unit 100 arrives in each position. Further, since the restricting position K1 is set higher than the initial position K0, the open angle of the image reading unit 100 can be widened without increasing the overall length of the coupling link 181.

In the above-described embodiment, both the first hinges J1 and second hinges J2 are provided on the rear surface 1*a* of the multifunction device 1, and the opening 84*a* is formed in the front surface 1*b* of the main casing 3 for inserting and removing the process unit 17. With this construction, the operator can pivotally move both the document cover 140 and the image reading unit 100 and replace the process unit 17 all from the front side of the multifunction device 1.

If the opening 84*a* and the discharge tray 46 were in an overlapping relationship, the discharge tray 46 would have to be removed before replacing the process unit 17. However, in the multifunction device 1 according to the above-described embodiment, the opening 84*a* and the discharge tray 46 are provided in different positions so that the process unit 17 can be replaced while the discharge tray 46 remains mounted, thereby facilitating replacement.

In the above-described embodiment, the protrusion 187 is guided to the restricting position K1 along the guiding groove 163 as the image reading unit 100 is pivotally moved open. When the protrusion 187 arrives at the restricting position K1, the groove wall 164 simultaneously restricts further movement in the opening direction. This construction eliminates the need for a separate operation to restrict the movement of the protrusion 187 (such as an operation to set the protrusion 187 in a restricting position), thereby improving operability.

Further, since the support shaft 193 for retaining the coupling link 181 is formed in the recessed portion 106A, the vertical space required for accommodating the coupling link 181 can be made smaller than when the support shaft 193 is disposed so as to protrude downward from the bottom wall 105 of the image reading unit 100, for example.

In the above-described embodiment, the groove walls 164 are provided on the rear end of the guiding grooves 163 for restricting movement of the protrusions 187. Since the guiding grooves 163 function both to guide and to engage (to restrict movement of) the protrusions 187, fewer parts are needed than when these functions are performed by separate members, thereby simplifying the construction.

While the invention has been described in detail with reference to the specific embodiment thereof, it would be apparent to those skilled in the art that various changes and modifications may be made therein without departing from the spirit of the invention.

(1) For example, in the above-described embodiment, the pivoting-restricting member 150 is configured of the coupling link 181 and the holding plate 161. However, a pivoting-restricting member can be any construction capable of restricting pivotal movement of the image reading unit in the opening direction when the image reading unit is already in the open position. For example, instead of the holding plate, a hook for engaging with the coupling link in the open position may be provided.

(2) In the above-described embodiment, the coupling link 181 is provided on the image reading unit 100, while the holding plate 161 is provided on the image forming unit 2. However, a holding plate may be provided on the image reading unit, and a coupling link on the image forming unit.

(3) In the above-described embodiment, the guiding groove 163 in the holding plate 161 is formed in the horizontal direction. However, a guiding groove may be formed vertically or in some other direction, provided that the construction can restrict the image reading unit from pivotally moving in the opening direction once the image reading unit is already in the open position.

What is claimed is:

1. An image forming apparatus comprising:

an image forming unit that forms an image on a recording medium, the image forming unit having a predetermined surface and a first receiving surface, the first receiving surface comprising a semispherical protrusion having a convex surface with a curvature and a locking hole at its apex portion;

a discharge tray provided on the predetermined surface for receiving the recording medium discharged from the image forming unit;

an image reading unit disposed in confrontation with the discharge tray for reading an image from an original document, the image reading unit having a second receiving surface that confronts the first receiving surface, the second receiving portion having a concave surface that substantially follows the curvature of the convex surface, the second receiving portion provided at a position confronting the semispherical protrusion;

a coupling portion disposed at a first position on the image forming unit, the coupling portion coupling the image reading unit with the image forming unit, allowing the image reading unit to pivotally move about a first pivoting axis, the image reading unit being pivotally movable between a closed position at which the image reading unit covers the discharge tray and an open position at which the image reading unit exposes the discharge tray, the image reading unit being pivotally movable both in an opening direction toward the open position and in a closing direction toward the closed position;

a pivoting-restricting portion disposed at a second position different from the first position, the pivoting-restricting portion restricting pivotal movement of the image reading unit past the open position in the opening direction; and wherein an elastic holding portion is provided inside the concave surface, the elastic holding portion engaging with the locking hole when the image reading unit is in the closed position.

2. The image forming apparatus according to claim 1, wherein, when the image reading unit is in the open position, an open angle of the image reading unit with respect to the image forming unit is less than or equal to 90 degrees.

3. The image forming apparatus according to claim 1, wherein the pivoting-restricting portion comprises:

an engaging member disposed on one of the image forming unit and the image reading unit; and a linking member that links the image forming unit and the image reading unit, the linking member having:

a first end supported on the other one of the image forming unit and the image reading unit; and a second end engaged with the engaging member.

4. The image forming apparatus according to claim 3, wherein the image forming unit and the image reading unit have one side and another side opposite the one side;

wherein the first position is located on the one side; and wherein the second position is closer to the other side than to the one side.

5. The image forming apparatus according to claim 4, wherein the first position is located upstream of the discharge tray in a discharge direction in which the recording medium is discharged; and wherein the second position is located downstream of the first position in the discharge direction.

6. The image forming apparatus according to claim 5, wherein the first end of the linking member is pivotally supported on the other one of the image forming unit and the image reading unit;

wherein the linking member has a protrusion provided on the second end; and wherein the engaging member is formed with a guiding groove that guides the protrusion to move to a restricting position in cooperation with the pivotal movement of the image reading unit, the restricting position being a position at which further movement of the protrusion is restricted.

7. The image forming apparatus according to claim 6, wherein the guiding groove has one end serving as the restricting position; and wherein the one end of the engaging member has a restricting wall contactable with the protrusion, and configured to restrict the further movement of the protrusion.

8. The image forming apparatus according to claim 7, wherein the guiding groove is formed to penetrate through the engaging member;

wherein the protrusion is inserted into the guiding groove in an insertion direction;

wherein the protrusion has a protruding end that protrudes from the guiding groove;

wherein the engaging member has a side surface perpendicular to the insertion direction; and wherein the protrusion has at least one retaining portion provided on the protruding end, the at least one retaining portion extending outward in a direction perpendicular to the insertion direction and confronting the side surface of the engaging member, and configured to prevent the protrusion from being pulled out of the guiding groove.

9. The image forming apparatus according to claim 3, wherein the pivoting-restricting portion further comprises an urging member disposed to span between the linking member and the one of the image forming unit and the image reading unit, the urging member elastically stretching when the image reading unit pivotally moves from the open position to the closed position.

10. The image forming apparatus according to claim 6, wherein the image reading unit is formed with an accommodating recessed portion; and wherein the pivoting-restricting portion further comprises a support shaft fixed to the image reading unit and disposed in the accommodating recessed portion, the support shaft pivotally supporting the linking member.

11. The image forming apparatus according to claim 1, wherein the pivoting-restricting portion comprises a pair of pivoting-restricting portions disposed at both ends of the image forming unit with respect to the first pivoting axis.

12. The image forming apparatus according to claim 1, wherein the image reading unit is a flatbed image scanner that scans an image from an original document while moving an image sensor across the original document, the image reading unit comprising:

an image-reading-unit casing;

a document support member disposed on the image-reading-unit casing and supporting an original document thereon; and a document cover pivotally supported on the image-reading-unit casing, the document cover being pivotally movable about a second pivoting axis that is parallel to the first pivoting axis and that is positioned farther from the image forming unit than the first pivoting axis is, wherein the image-reading-unit casing has a first open angle about the first pivoting axis;

wherein the document cover has a second open angle about the second pivoting axis; and wherein a sum of the first open angle and the second open angle is less than or equal to 90 degrees.

13. The image forming apparatus according to claim 12, further comprising a process unit, wherein the image forming unit and the image reading unit have front and rear surfaces;

wherein the first pivoting axis and the second pivoting axis are positioned on the rear surface; and wherein the front surface of the image forming unit has an opening through which the process unit can be inserted into or removed from the image forming unit.

14. The image forming apparatus according to claim 1, wherein the predetermined surface is a top surface located at a top of the image forming unit when the image forming apparatus is disposed in an orientation in which the image forming apparatus is intended to be used; and wherein the image reading unit is located above the discharge tray.

15. An image forming apparatus comprising:

an image forming unit that forms an image on a recording medium, the image forming unit having a predetermined surface;

a discharge tray provided on the predetermined surface for receiving the recording medium discharged from the image forming unit;

an image reading unit disposed in confrontation with the discharge tray for reading an image from an original document;

a coupling portion disposed at a first position on the image forming unit located upstream of the discharge tray in a discharge direction in which the recording medium is discharged, the coupling portion coupling the image reading unit with the image forming unit, allowing the image reading unit to pivotally move about a first pivoting axis, the image reading unit being pivotally movable between a closed position at which the image reading unit covers the discharge tray and an open position at which the image reading unit exposes the discharge tray, the image reading unit being pivotally movable both in an opening direction toward the open position and in a closing direction toward the closed position;

a pivoting-restricting portion disposed at a second position located downstream of the first position in the discharge direction, the pivoting-restricting portion restricting pivotal movement of the image reading unit past the open position in the opening direction, wherein the pivoting-restricting portion comprises an engaging member disposed on the image forming unit, the engaging member having a guiding groove that guides a protrusion to move to a restricting position in cooperation with the pivotal movement of the image reading unit, the restricting position being a position at which further movement of the protrusion is restricted; and a linking member disposed on the image reading unit that links the image forming unit and the image reading unit, the linking member having:

a first end pivotally supported on the image forming unit;

a second end engaged with the engaging member; and the protrusion provided on the second end;

wherein the image forming unit and the image reading unit have one side and another side opposite the one side;

wherein the first position is located on the one side;

wherein the second position is closer to the other side than to the one side;

wherein the guiding groove has:

a first groove position provided at one end of the guiding groove; and a second groove position provided at another end opposite the first groove position, the second groove position serving as the restricting position;

wherein the protrusion is movable between the first groove position and the second groove position, the protrusion being located at the first groove position when the image reading unit is in the closed position, the protrusion being located at the second groove position when the image reading unit is in the open position;

wherein the guiding groove has a sloped portion having a gradient rising from the first groove position toward the second groove position; and wherein the second groove position is located at a position higher than the first groove position when the image forming apparatus is disposed in an orientation in which the image forming apparatus is intended to be used.

16. The image forming apparatus according to claim 15 wherein the image forming unit has a first receiving surface that confronts the image reading unit;

wherein the image reading unit has a second receiving surface that confronts the first receiving surface; and wherein the first receiving surface and the second receiving surface contact each other when the image reading unit is in the closed position.

17. The image forming apparatus according to claim 16, wherein the image forming unit comprises a semispherical protrusion provided on the first receiving surface, the semispherical protrusion having a convex surface with a curvature; and wherein the image reading unit comprises a receiving portion provided at a position confronting the semispherical protrusion, the receiving portion having a concave surface that substantially follows the curvature of the convex surface.

18. The image forming apparatus according to claim 17, wherein the semispherical protrusion has a locking hole at its apex portion; and wherein an elastic holding portion is provided inside the concave surface, the elastic holding portion engaging with the locking hole when the image reading unit is in the closed position.

* * * * *